US008225912B2

(12) United States Patent
Dalman et al.

(10) Patent No.: US 8,225,912 B2
(45) Date of Patent: Jul. 24, 2012

(54) RAILROAD FREIGHT CAR BRAKE BEAM STRUT ASSEMBLY AND METHOD OF MANUFACTURING SAME

(75) Inventors: John A. Dalman, Elburn, IL (US); Michael A. Weber, Gurnee, IL (US)

(73) Assignees: Miner Enterprises, Inc., Geneva, IL (US); Powerbrace Corporation, Kenosha, WI (US)

( * ) Notice: Subject to any disclaimer, the term of this patent is extended or adjusted under 35 U.S.C. 154(b) by 1083 days.

(21) Appl. No.: 12/157,037

(22) Filed: Jun. 6, 2008

(65) Prior Publication Data

US 2009/0301826 A1 Dec. 10, 2009

(51) Int. Cl.
*B61H 13/36* (2006.01)

(52) U.S. Cl. ..... 188/229.1; 188/229.6

(58) Field of Classification Search ..... 188/219.1, 188/222.1, 223.1, 223.6, 226.1, 228.1, 229.6; 29/505

See application file for complete search history.

(56) References Cited

U.S. PATENT DOCUMENTS

| | | | | |
|---|---|---|---|---|
| 430,756 | A | 6/1890 | Robischung | |
| 800,409 | A | 9/1905 | Sharp | |
| 1,943,271 | A | 1/1934 | Ivemeyer | |
| 2,047,732 | A | 7/1936 | Harbert | |
| 2,330,748 | A * | 9/1943 | Sagstetter | 188/229.6 |
| 2,364,021 | A | 11/1944 | Flesch | |
| 2,398,917 | A | 4/1946 | Busch | |
| 2,547,860 | A | 4/1951 | Flesch | |
| 2,570,202 | A | 10/1951 | Busch | |
| 2,930,329 | A | 3/1960 | Busch | |
| 3,690,270 | A | 9/1972 | Gutmann, Jr. et al. | |
| 4,194,599 | A | 3/1980 | Cole | |
| 4,787,129 | A | 11/1988 | Williamson | |
| 4,831,905 | A | 5/1989 | Murchinson | |
| 4,956,525 | A | 9/1990 | Wilk | |
| 5,810,124 | A | 9/1998 | Sandmann | |
| 6,155,389 | A | 12/2000 | Sandmann | |
| 6,193,028 | B1 | 2/2001 | Elizalde-Siller et al. | |
| 6,234,283 | B1 | 5/2001 | Montes-Ramos | |
| 6,543,955 | B2 | 4/2003 | Conaway et al. | |
| 7,077,411 | B2 | 7/2006 | Peters et al. | |
| 8,025,133 | B2 * | 9/2011 | De La Pena | 188/228.1 |
| 2006/0108187 | A1 | 5/2006 | Steffen | |
| 2007/0039783 | A1 | 2/2007 | Doran | |

(Continued)

OTHER PUBLICATIONS

International Searching Authority/ USPTO; International Search Report regarding PCT/US2009/003369; Jul. 24, 2009; 2 pages.

(Continued)

*Primary Examiner* — Christopher Schwartz
(74) *Attorney, Agent, or Firm* — Law Office of John W. Harbst

(57) ABSTRACT

A method of manufacturing a railroad freight car brake beam strut assembly including the steps of: providing a railroad freight car brake beam strut having an axially aligned slot defined between first and second sides of the strut, with each side of the strut defining a bore opening to the slot and to an exterior of the strut, with the bores defined by the strut being aligned relative to each other along an axis extending generally normal to a longitudinal axis of the strut. The methodology of the present disclosure further includes the step of: pressing a brake pin bushing into each bore of the strut in a direction extending away from the longitudinal axis of the strut. A railroad freight car strut assembly is also disclosed.

25 Claims, 20 Drawing Sheets

U.S. PATENT DOCUMENTS

2010/0025170 A1* 2/2010 Centeno et al. ..... 188/226.1

OTHER PUBLICATIONS

International Searchoing Authority/USPTO; Written Opinion of the International Searching Authority regardiung PCT/US2009/003369; Jul. 24, 2009; 7 pages.

International Searching Authority/USPTO; International Search Report regarding PCT/US2009/03406; Jul. 30, 2009; 2 pages.

International Searching Authority/USPTO; Written Opinion of the International Searching Authority regarding PCT/US2009/03406; Jul. 30, 2009; 8 pages.

International Searching Authority/USPTO; International Search Report regarding PCT/US2009/03372; Jul. 28, 2009; 2 pages.

International Searching Authority/USPTO; Written Opinion of the International Searching Authority regarding PCT/US2009/03372; Jul. 28, 2009; 5 pages.

* cited by examiner

RAILROAD FREIGHT CAR BRAKE BEAM STRUT ASSEMBLY AND METHOD OF MANUFACTURING SAME

FIELD OF THE DISCLOSURE

The present disclosure generally relates to railroad freight cars and, more particularly, to a a strut assembly for a railroad freight car brake beam assembly and a method of manufacturing such a railroad freight car strut assembly.

BACKGROUND OF THE DISCLOSURE

Railroad freight cars typically include an elongated car body supported toward opposite ends by a pair of wheeled trucks. Each wheeled truck includes a bolster laterally extending between two side frames with a wheel and axle assembly arranged to front and rear sides of the bolster. Each railcar also has a brake system operably associated therewith. A conventional brake system includes a brake beam assembly associated with each wheel and axle assembly and which is connected to brake rigging on the railcar. Each brake beam assembly is supported between the truck side frames to allow it to be operated into and out of braking positions in relation to the respective wheel and axle assembly.

One form of brake beam assembly commonly used in the railcar industry includes a compression member and a tension member arranged in a truss-like configuration with a strut assembly extending therebetween. A brake head, with a replaceable brake shoe, is arranged at each end of the brake beam assembly. It has been found beneficial for the brake beam assembly to maintain both a degree of camber in the compression member and a degree or level of tension in the tension member.

Brake beam assemblies on the railcar are typically operated in simultaneous relation by a power source from a brake cylinder or a hand brake and, through leverage, transmit and deliver braking forces to the brake shoes at the wheels of each wheel and axle assembly. On a typical railcar, brake rigging, including a brake push rod, transmits force, caused by the push of air entering the brake cylinder or by the pull of the hand brake, to the brake shoes.

The brake rigging on the railcar, used to transmit and deliver braking forces to the braking shoes of each wheel assembly, comprises a multitude of linkages including various levers, rods and pins. For example, brake levers are used throughout the brake rigging on each car to transmit as well as increase or decrease the braking force on each wheel and axle assembly A conventional strut assembly on a railroad freight car brake beam assembly includes an elongated strut having a hollow center portion and two joined sides or walls, with one side being arranged on opposite sides of a longitudinal axis of the strut. When the brake beam assembly is assembled, the strut is operably connected to the tension and compression members proximate midlength of such members. A conventional strut has an axially elongated and generally centralized, close-ended slot between the two sides of thereof. Typically, a central portion of a brake lever extends through and is pivotally mounted in the slot between the opposed sides of the strut. Besides being pivotally supported by the strut, opposite ends of the brake lever are articulately connected through suitable connections to the railcar brake rigging. About midlength thereof, the strut defines two openings or bores aligned along an axis extending generally normal to the longitudinal axis of the strut. A lengthwise portion of a pivot pin passes endwise through the bores and through the central portion of the brake lever to define an axis about which the brake lever pivots during railcar operation.

To lower the upper end of the brake lever relative to the position it would occupy if the brake lever were vertical, such brake levers are inclined lengthwise of the brake beam a certain number of degrees, usually about 40°. The strut is designed to accommodate suitable inclination of the brake lever from vertical. To reduce strut wear and to facilitate operation of the brake beam assembly during operation of the railcar, a conventional strut assembly includes two brake pin bushings seated in the bores of the strut and which journal the pivot pin for the brake beam.

During use, a railcar can travel tens of thousands of miles between locations and over railbeds, some of which can be in significant disrepair. During railcar travel, the brake lever and related parts of the braking system are subject to vibration and wear. Accordingly, it is not unusual for one or more of the brake pin bushings to unseat from its respective strut bore and separate from the strut. The inclination of the bushings from vertical, coupled with gravity, also tends to cause at least one of the brake pin bushings to remove itself from the respective bore in the strut. Moreover, current research shows the brake pin bushings are exposed to forces and components of forces acting in a direction working to unseat or displace the brake pin bushings from their respective bore and be driven the out of position relative to the strut.

In some designs, the brake pin bushings are fabricated from a powder sintered metal. Unless powder sintered metal bushings are properly seated within their respective strut bore, such bushings can crack as they become displaced from their respective strut bore. Moreover, and even if such brake pin bushings remain partially seated in the strut bore, the powder sintered metal bushing is prone to chipping. Wear on the brake pin bushings can change the disposition about which the brake lever pivots, thus, changing the pressure exerted by the brake pads to the railcar wheels. Moreover, and under the rules of the American Association of Railroads (the "AAR"), bushing wear and cracking can result in condemnation of the brake beam assembly.

For a myriad of reasons, railroad freight cars are routinely inspected. Part of the inspection process involves an analysis of each railcar brake beam assembly on the railcar. When a particular railroad freight car is identified as having a brake beam assembly requiring repair or replacement, the freight car requiring such repair is usually separated from the remaining cars in the train consist and, then, moved to a facility where such repairs can be affected. Only after a suitable repair facility has been identified and becomes available, can replacement of a condemned brake beam assembly be affected.

Replacing a railcar brake beam assembly, for whatever reason, can be a time consuming process. Moreover, the valuable time lost in separating the railcar with the condemned brake beam from the remaining cars in the train consist, coupled with the time lost in scheduling a repair facility to accomplish replacement of the brake beam assembly, and the valuable time lost in affecting the repair or replacement of the condemned brake beam, along with the time lost in having to move the car with the condemned brake beam to the repair facility for replacement of the brake beam assembly are other considerations and unrealized costs involved with replacing a condemned brake beam. Of course, during this entire time period, the railcar is removed from service. Replacement of the condemned brake beam must also include the time lost in joining the repaired car to a train consist directed toward the original destination of the repaired car.

Thus, there is a continuing need and desire for a railroad freight car strut assembly and method of manufacturing a railroad freight car brake beam strut assembly wherein the brake pin bushings are inhibited from inadvertent displacement away from the axis of the strut assembly whereby extending the life of the strut assembly and thus reducing the time and expense the railcar can be out of service due to a faulty brake beam assembly.

BRIEF DESCRIPTION OF THE DISCLOSURE

In view of the above, and in accordance with one aspect, there is provided a method of manufacturing a railroad freight car brake beam strut assembly including the step of: providing a railroad freight car brake beam strut having a hollow center portion and an axially aligned slot defined between first and second joined sides or walls of the strut, with each side of the strut defining a bore opening to the hollow center portion and to an exterior of the strut, with the bores defined by the strut being aligned relative to each other along an axis extending generally normal to a longitudinal axis of the strut. The methodology of the present disclosure further includes the step of: pressing a bushing into each bore of the strut in a direction extending away from the longitudinal axis of the strut. The methodolgy of the present invention disclosure also includes the step of: providing a positive stop defined by the strut toward an end of each bushing disposed furthest from a longitudinal axis of the strut for inhibiting each brake pin bushing from moving therepast after each bushing is inserted into each bore defined by the strut.

Preferably, the method of manufacturing a railroad freight car brake beam strut assembly can include the further step of: configuring at least one end of each bushing to facilitate and guide its entry into one of the bores defined by the strut.

According to another aspect, there is provided a method of manufacturing a railroad freight car brake beam strut assembly including the step of: providing a railroad freight car brake beam strut having a hollow center portion along with an axially aligned slot defined between first and second joined sides or walls of the strut, with the first side of the strut defining a first bore opening to the hollow center portion and to an exterior of the strut, and with the second side of the strut defining a second bore opening to the hollow center portion and to the exterior of the strut, and with the first and second bores defined by the strut being aligned relative to each other along an axis extending generally normal to a longitudinal axis of the strut and which is angled relative to vertical when the strut assembly is connected to a brake beam assembly. The method of manufacturing the railroad freight car brake beam strut assembly includes the further step of: pressing a first brake pin bushing into the first bore of the strut in a direction extending away from the longitudinal axis of the strut. The method of manufacturing the railroad freight car brake beam strut assembly further includes the step of: pressing a second brake pin bushing into the second bore of the strut in a direction opposed to the direction the first brake pin bushing is pressed into the first bore and extending away from the longitudinal axis of the strut. The method of manufacturing the railroad freight car brake beam strut assembly also includes the step of: providing a positive stop on the strut toward an end of each bushing disposed a furthest distance from a longitudinal centerline of the strut for inhibiting each brake pin bushing from moving therepast after each bushing is inserted into each bore defined by the strut.

Preferably, the method of manufacturing the railroad freight car brake beam strut assembly includes the further step of: configuring at least one end of each brake pin bushing to facilitate and guide their entry into one of the bores defined by the strut. In one form, each bushing defines an opening extending therethrough.

The method of manufacturing a railroad freight car brake beam strut assembly involves the further step of: repositioning the strut after the first brake pin bushing is pressed into the first bore and before the second brake pin bushing is pressed into the second bore in the strut. In one form, the method of manufacturing the railroad freight car brake beam strut assembly includes the further step of: extending a tool, operably coupled to a press, through the opening in the first brake pin bushing so as to press the second brake pin bushing into the second bore of the strut in a direction opposed to the direction the first brake pin bushing is pressed into the first bore and extending away from the longitudinal axis of the strut.

In one form, the positive stop includes an annular lip provided on the strut in operable combination with each brake pin bushing. Preferably, the positive stop for each bushing is formed integral with the strut.

According to another aspect, there is provided a method of manufacturing a railroad freight car brake beam strut assembly including the step of: providing a railroad freight car brake beam strut having a hollow center portion along with an axially aligned slot defined between first and second joined sides of the strut, with the first side of the strut defining a first bore opening to the slot and to an exterior of the strut, and with the second side of the strut defining a second bore opening to the slot and to the exterior of the strut, with the first and second bores defined by the strut being aligned relative to each other along an axis extending generally normal to a longitudinal axis of the strut. The method of manufacturing the railroad freight car brake beam strut assembly includes the further step of: pressing a first sintered powdered metal bushing into the first bore of the strut in a direction extending away from the longitudinal axis of the strut. Moreover, the method of manufacturing the railroad freight car brake beam strut assembly includes the further step of: pressing a second sintered powdered metal bushing into the second bore of the strut in a direction opposed to and paralleling the direction the first bushing is pressed into the first bore and extending away from the longitudinal axis of the strut. The method of manufacturing the railroad freight car brake beam strut assembly further includes the step of: providing a first stop on the strut toward that end of the first bore disposed furthest from the longitudinal centerline of the strut for inhibiting the first brake pin bushing from longitudinally separating from the strut after being pressed into the first bore defined by the strut. Moreover, the method of manufacturing the railroad freight car brake beam strut assembly further includes the step of: providing a second stop on the strut toward that end of the second bore disposed furthest from the longitudinal centerline of the strut for inhibiting the second brake pin bushing from longitudinally separating from the strut after being pressed into the first bore defined by the strut.

Preferably, the method of manufacturing the railroad freight car brake beam strut assembly includes the further step of: configuring at least one end of each bushing to facilitate and guide its entry into one of the bores defined by the strut. In one form, the method of manufacturing a railroad freight car brake beam strut assembly includes the further step of: repositioning the strut after the first bushing is pressed in the first bore and before the second bushing is pressed into the second bore in the strut. In one form, the positive stop for each bushing is formed integral with the strut.

According to yet another aspect, there is provided a railroad freight car brake beam strut assembly including an elongated strut defining a longitudinal axis and having a hollow center portion with an axially elongated slot between first and second joined walls of the strut. The slot in the strut is inclined a predetermined number of degrees from vertical for accommodating an elongated brake lever extending through the strut. Each side wall of the strut defines a bore opening to the hollow center portion and to an exterior of the strut. The strut bores are aligned relative to each other to accommodate a lengthwise portion of a brake lever pivot pin extending through strut thereby connecting the brake lever to the strut and so as to define an axis about which the brake lever pivots. The strut assembly further includes a pair of brake pin bushings. One brake pin bushing is accommodated in each strut bore so as to journal the lengthwise portion of the brake lever pivot pin extending through the strut. Each brake pin bushing has first and second axially spaced ends. The strut assembly furthermore includes a positive stop defined by the strut toward an end of each bushing disposed a furthest distance from the longitudinal centerline of the strut. At least a portion of each stop extends radially inward from an inner diameter of a respective bore for inhibiting the respective brake pin bushing from moving therepast after each bushing is inserted into each bore defined by the strut.

Preferably, each brake pin bushing of the strut assembly is sized relative to the respective strut bore such that an interference fit is established between a periphery of the brake pin bushing and an inside diameter of the bore defined by the strut. In a preferred form, each brake pin bushing is formed from powdered sintered metal material.

There is also provided a railroad freight car brake beam strut assembly including an elongated strut defining a longitudinal axis and having a hollow center portion with an axially elongated slot between first and second joined walls of the strut. The slot in the strut is inclined a predetermined number of degrees from vertical for accommodating an elongated brake lever extending through the strut. Each side wall of the strut defines a bore opening to the hollow center portion and to an exterior of the strut. The bores defined by the walls on the strut are aligned relative to each other to accommodate a brake lever pivot pin extending through the strut thereby connecting the brake lever to the strut and so as to define an axis about which the brake lever pivots. The strut assembly also includes a pair of brake pin bushings. One brake pin bushing is accommodated in each bore defined b the strut so as to journal the brake lever pivot pin. A stop is provided on the strut toward an end of each bushing disposed a furthest distance from the longitudinal centerline of the strut for inhibiting each brake pin bushing inserted into each bore from moving therepast whereby maintaining each bushing in a predetermined relation relative to said strut.

Preferably, each brake pin bushing is sized relative to the bore in the strut such that an interference fit is established between a periphery of the brake pin bushing and the inner diameter of the bore defined by the strut. In one form, each brake pin bushing is formed from powdered sintered metal material. In one embodiment, each of the stops is formed integral with said strut. In one form, each stop extends radially inward from an inner diameter of the bore into which each bushing is inserted.

There is also disclosed a railroad freight car brake beam strut assembly including an elongated strut defining a longitudinal axis and having a hollow center portion with an axially elongated slot between first and second joined walls of the strut. The slot in the strut is inclined a predetermined number of degrees from vertical for accommodating an elongated brake lever extending through the strut. Each side wall of the strut defines a bore opening to the hollow center portion and to an exterior of the strut. The bores defined by the walls on the strut are aligned relative to each other to accommodate a brake lever pivot pin extending through the strut thereby connecting the brake lever to the strut and so as to define an axis about which the brake lever pivots. The strut assembly further includes a pair of brake pin bushings. At least one brake pin bushing is accommodated in each bore defined by the strut so as to journal the brake lever pivot pin. Each brake pin bushing includes a first end, disposed farthest from the longitudinal axis of said strut after said bushing is inserted into said bore and into operable association with said strut, and a second end disposed closer to the longitudinal axis of the strut than is the first end after the bushing is inserted into the bore and into operable association with the strut. The strut assembly further includes a stop on the strut and operably associated with the first end of each bushing for limiting the extent to which each brake pin bushing can move in a direction away from the longitudinal axis of the strut.

Preferably, each brake pin bushing is sized relative to the respective bore in the strut such that an interference fit is established between a periphery of the brake pin bushing and an inner diameter of the respective bore defined by the strut. In one embodiment each brake in bushing is formed from powdered sintered metal material. In a preferred form, each stop is formed integral with said strut. Moreover each stop preferably extends radially inward from an inner diameter of the bore into which each bushing is inserted.

DETAILED DESCRIPTION OF THE DISCLOSURE

Figure 1:
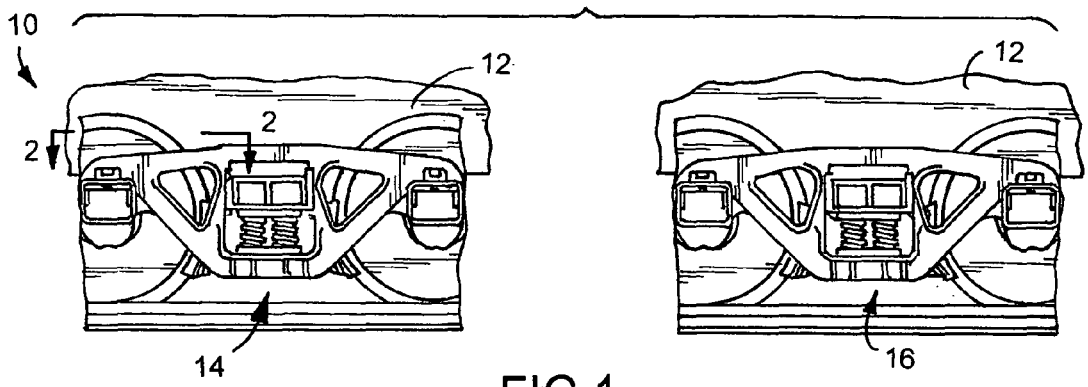
FIG. 1 is a fragmentary side elevational view of a railroad car having railroad car trucks arranged toward opposite ends thereof.

While the present disclosure is susceptible of embodiment in multiple forms, there is shown in the drawings and will hereinafter be described preferred methods of manufacture, and the present disclosure is to be considered as setting forth exemplifications of various embodiments and methodologies which are not intended to limit the disclosure to the specific embodiments illustrated and methodologies described.

Referring now to the drawings, wherein like reference numerals indicate like parts throughout the several views, FIG. 1 shows a railroad freight car 10 including a car body 12. Typically, the car body 12 is supported, toward opposite ends and in operable combination with a pair of wheeled trucks 14 and 16 for movement over tracks T. The wheeled trucks 14 and 16 are substantially similar to each other and, thus, only wheeled truck 14 will be discussed in detail.

Figure 2:
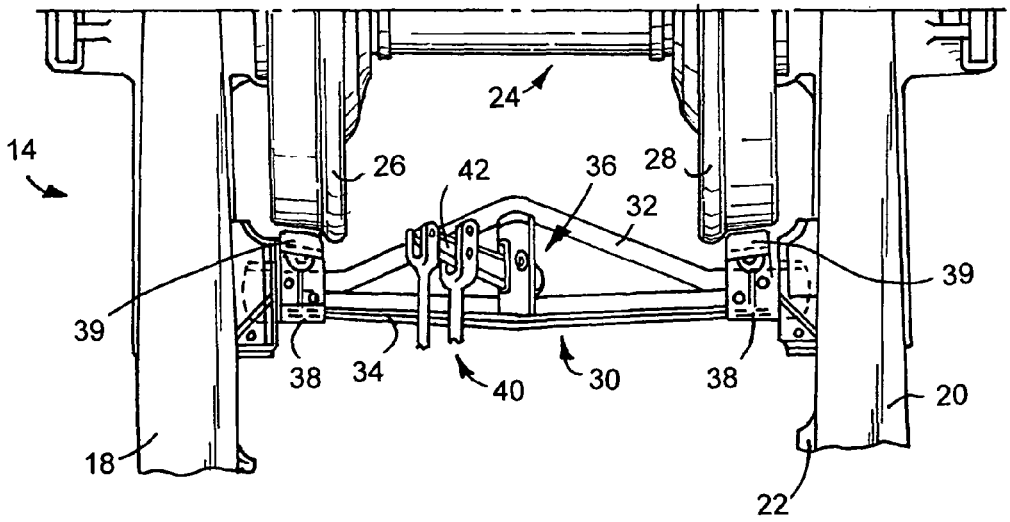
FIG. 2 is a fragmentary plan view of a brake beam assembly associated with one of the railroad car trucks shown in FIG. 1.

As shown in FIG. 2, each wheeled truck includes a pair of side frames 18 and 20 with a bolster 22 extending laterally therebetween and upon which car body 12 (FIG. 1) is pivotally supported. The side frames 18, 20 are usually of one-piece construction and formed from cast steel. Although only one is partially shown in FIG. 2, those skilled in the art will appreciate a conventional wheel and axle assembly 24 is provided on each side of the bolster 22 between the side frames 18, 20 and in operable combination with each truck. As is typical, each wheel and axle assembly 24 includes a pair of laterally spaced and flanged wheels 26 and 28.

Each wheel and axle assembly 24 on railcar 10 has a brake beam assembly 30 arranged in operable combination therewith. In the illustrated embodiment, the side frames 18, 20 on each truck conventionally guide and support the brake beam assembly 30 for generally horizontal sliding movements. As shown in FIG. 2, a conventional brake beam assembly 30 includes several interrelated components including a tension member 32, a compression member 34, and a strut assembly 36. In the illustrated embodiment, the tension member 32 and compression member 34 are arranged in a truss-like configuration and laterally extend between the two side frames 18 and 20 for guided movements.

Typically, each brake beam assembly 30 has brake heads 38 with friction brake shoes 39 disposed toward opposed ends thereof for engagement with the respective wheels 26, 28 of an associated wheel and axle assembly. The brake shoes 39 are moved into and out of braking relation with the wheels 26, 28 of a respective wheel and axle assembly through brake rigging, generally identified in FIG. 2 by reference numeral 40, which is responsive to operation of an air cylinder (not shown) or a hand brake mechanism (not shown).

The strut assembly 36 of the brake beam assembly 30 shown in FIG. 2 is generally centralized along the lengths of and is operably connected toward opposite ends to tension member 32 and compression member 34 in a conventional manner. In operation, strut assembly 36 holds member 34 to its camber and member 32 to its bowed shape. A brake lever 42 forming part of the brake rigging 40 is fulcrumed intermediate opposite ends in each strut assembly 36.

Figure 3:
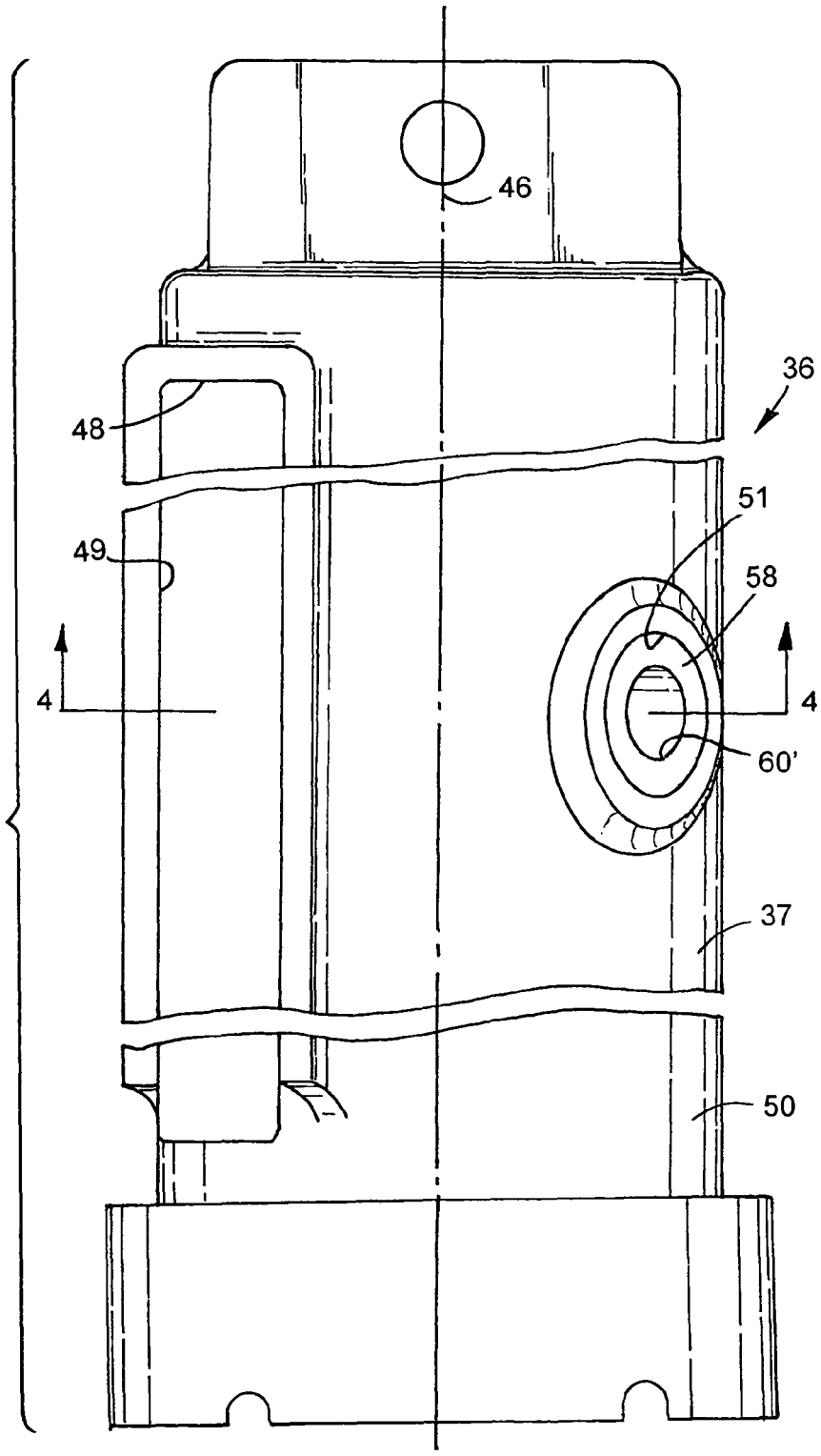
FIG. 3 is an enlarged plan view of a brake beam strut assembly embodying principals of the present disclosure.

A methodology for manufacturing the strut assembly 36 is disclosed. According to the present disclosure, the method for manufacturing a railroad freight car brake beam strut assembly includes the step of providing a railroad freight car brake beam strut, identified generally in FIG. 3 by reference numeral 37. As shown in FIG. 3, strut 37 has a hollow center portion 41 and defines an elongated axis 46 for the strut assembly 36. Strut 37 further defines an elongated slot 48 having a closed margin 49. Strut 37 has a first end 37' configured for suitable attachment to the tension member 32 and a second end 37" configured for suitable attachment to compression member 34. Slot 48 in strut 37 allows the brake lever 42 (FIG. 4) to extend endwise through the strut 37.

Figure 4:
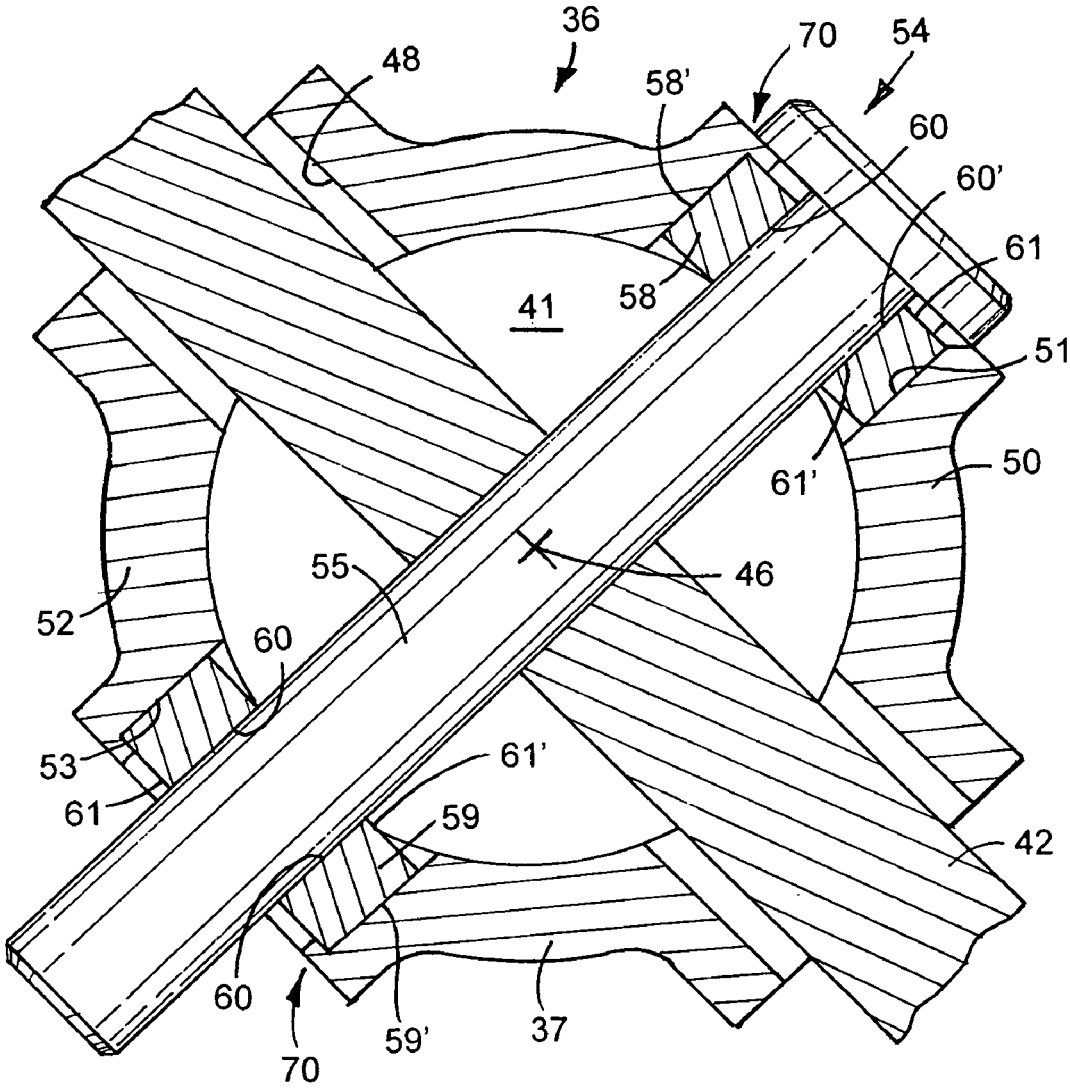
FIG. 4 is sectional view taken along line 4-4 of FIG. 3.

As shown in FIG. 4, strut 37 includes first and second generally parallel sides or walls 50 and 52 disposed to opposed sides of the elongated axis 46 and defining the slot 48 therebetween. To lower the upper end of the brake lever 42, and after the strut 37 is operably connected to tension member 32 and compression member 34 (FIG. 2), slot 48 is inclined a predetermined number of degrees from vertical. In one embodiment, and after the strut 37 is operably connected to member 32 and member 34, slot 48 therein is inclined about 40° from vertical.

As shown in FIG. 4, each side wall 50 and 52 of the strut 37 defines a bore 51 and 53, respectively. Each bore 51, 53 opens to the hollow center portion 41 and to an exterior of the strut 37. The bores 51, 53 defined by strut 37 are aligned relative to each other and accommodate a brake lever pivot pin 54 extending through the strut 37 and thereby connecting the brake lever 42 to the strut 37 and so as to define an axis 55 about which the brake lever 42 pivots during operation of the brake assembly 30 (FIG. 2). The axis 55 about which brake lever 42 pivots extends generally normal to and preferably intersects with the elongated axis 46 of strut 37.

To reduce wear on the strut 36 resulting from continuous pivoting movements of the brake lever 42 about axis 55, strut assembly 36 further includes a pair of brake pin bushings 58 and 59. Bushings 58 and 59 are accommodated in the bores 51 and 53, respectively, of the strut 37 so as to journal a lengthwise portion of the brake lever pivot pin 54 extending endwise therethrough. In a preferred form, the brake pin bushings 58 and 59 are substantially identical relative to each other and are preferably fabricated from a sintered powdered metal.

Brake pin bushing 58 has an outside diameter 58' sized to establish a snug fit within the bore 51 in the side wall 50 of strut 37. In one form, the each brake pin bushing is such that a press fit is established between the outside diameter of the brake pin bushing 58 and the inner diameter of the respective strut bore into which the brake pin bushing is to be inserted. Each brake pin bushing also defines a throughbore 60 having an inner diameter 60' which is sized relative to that portion of the brake lever pivot pin 54 passing theretrough. Moreover, brake pin bushing 58 has a first end 61 and an axially spaced second end 61'. As shown in FIG. 4, when each brake pin bushing 58, 59 is accommodated in the respective bore 51, 53 and into operable association with the strut 37, the first end 61 of each bushing 58, 59 is disposed a further distance from the axis 46 of strut 37 than is end 61'. Preferably, the axial spacing between the ends 61, 61' of brake pin bushing 58 is generally equal to the cross sectional wall thickness of the strut 37 (the distance measurable between inner and outer strut surfaces in the area wherein the bore 60 passes therethrough). Similarly, brake pin bushing 59 has an outside diameter 59' sized to establish a suitable press fit with the bore 53 in the side wall 52 of strut 37. Brake pin bushing 59 also defines a throughbore 60' having an inner diameter 60' which is sized relative to that portion of the brake lever pivot pin 54 passing therethrough. Moreover, brake pin bushing 59 has a first end 61 and an axially spaced second end 61'. Preferably, the axial spacing between the ends 61, 61' of brake pin bushing 59 is generally equal to the cross sectional wall thickness of the strut 37 (the distance measurable between inner and outer strut surfaces in the area wherein the bore 60 passes therethrough). Each brake pin bushing 58, 59 is sized such that it can be passed into and through the slot 48 and can be positioned between the side walls 50, 52 of the strut 37 in the hollow center portion 41 of the strut 37.

According to the present disclosure, the method for manufacturing a railroad freight car brake beam strut assembly includes the further step of pressing bushings 58, 59 into bores 51, 53, respectively, of the strut 37. Notably, however, and according to the present disclosure, each brake pin bushing 58, 59 is pressed into the respective bore 51, 53 of the strut 37 in a direction extending away from the longitudinal axis 46 of the strut 37.

Figure 5:
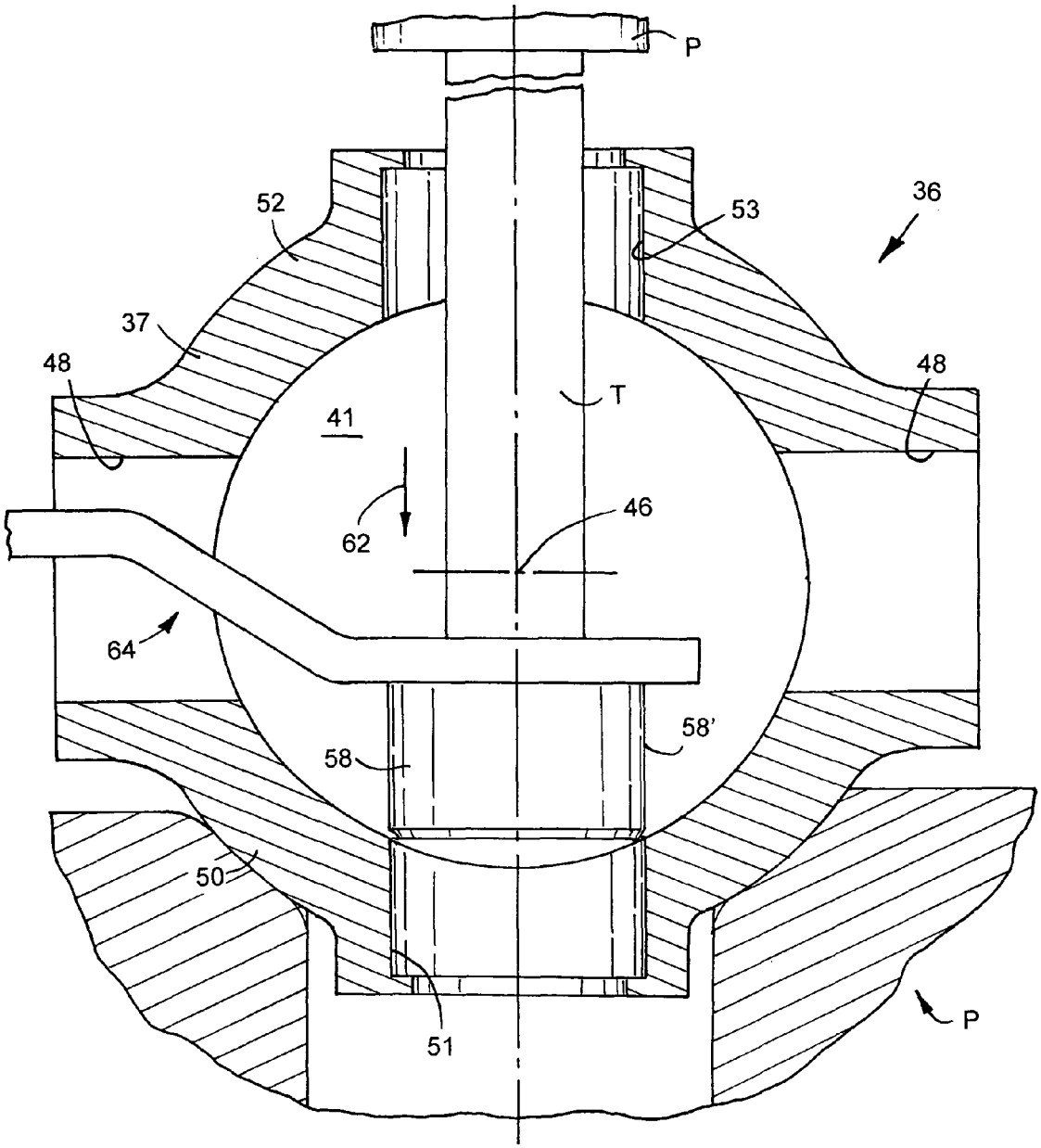
FIG. 5 is an enlarged sectional view illustrating one form of brake pin bushing being pressed into position relative to a brake beam strut.

As shown by way of example in FIG. 5, and before strut 37 is arranged in operable combination with tension member 32 and compression member 34, brake pin bushing 58 is passed through slot 48 between the side walls 50, 52 and into the hollow center portion 41 of the strut 37 and is positioned in alignment with the bore 51 in the side wall 50 of strut 37. After positioning and operably supporting the strut 37 in a conventional press P (FIG. 5), a tool T, operably coupled to press P, is extended through bore 53 of strut 37 to operably engage and press brake pin bushing 58 into the aligned bore 51 of strut 37 in a direction of arrow 62 extending generally normal to and away from the longitudinal axis 46 of strut 37.

In one form, a suitably configured plate or disc 63 is extended through the slot 48 between the side walls 50, 52 of strut 37 and is inserted between a distal end of the tool T and the brake pin bushing 58 to facilitate insertion of the brake pin bushing 58 into the bore 51 of the side wall 50 of the strut 37. In a most preferred form, the brake pin bushing 58 is pressed into the bore 51 defined by the side wall 50 until the brake pin bushing 58 reaches a predetermined position within bore 51 of strut 37. After the brake pin bushing 58 is positioned in bore 51 of strut 37, tool T is retracted and the plate or disc 62 is removed from the strut 37.

Figure 6:
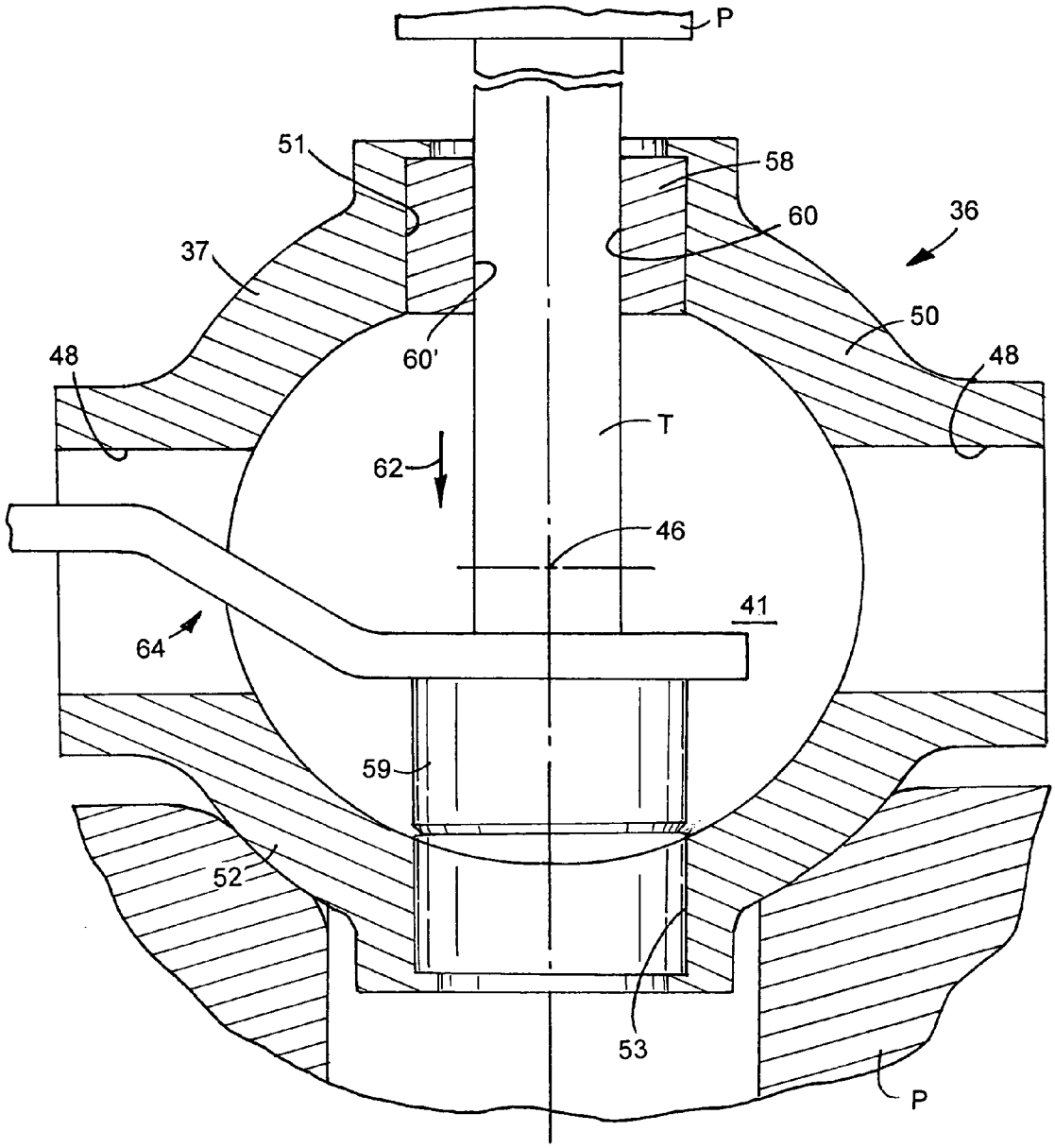
FIG. 6 is an enlarged sectional view similar to that shown in FIG. 5 showing one form of brake pin bushing being pressed into position relative to a brake beam strut.

In the example shown in FIG. 6, and before strut 37 is arranged in operable combination with tension member 32 and compression member 34, another step in the method for manufacturing a railroad freight car brake beam strut assembly includes the further step of repositioning the strut 37 after brake pin bushing 58 is pressed and positioned in bore 51 of strut 37 but before brake pin bushing 59 is pressed and positioned in the second bore 53 in strut 37. After repositioning the strut 37, brake pin bushing 59 is passed through slot 48 between the side walls 50, 52 and into the hollow center portion 41 of the strut 37 and is positioned in alignment with bore 53 in the strut side wall 51.

After strut 37 is repositioned and operably supported in press P, as shown in FIG. 6, brake pin bushing 59 is positioned in alignment with bore 53 in the strut side wall 51. Then, the tool T, operably coupled to press P, is extended through the bore 60 in brake pin bushing 58 to operably engage and press brake pin bushing 59 into bore 53 of strut 37 in a direction of arrow 62 extending generally normal to and away from the longitudinal axis 46 of strut 37.

To facilitate insertion of the brake pin bushing 59 into the bore 53 of the strut side wall 51, the above-mentioned plate or disc 63 is extended through the slot 48 between the side walls 50, 52 of the strut and is inserted between a distal end of the tool T and the brake pin bushing 59. In a most preferred form, brake pin bushing 59 is pressed into the bore 53 defined by the strut side wall 52 until the brake pin bushing 59 reaches a predetermined position within bore 53 of strut 37. After the brake pin bushing 59 is positioned in bore 53 of strut 37, tool T is retracted and the plate or disc 62 is removed from the strut 37. Of course it will be appreciated the sequence of pressing the brake pin bushings 58, 59 into their respective bores 51, 53 can be reversed from that described above without detracting or departing from the spirit and scope of the present disclosure.

Figure 7:
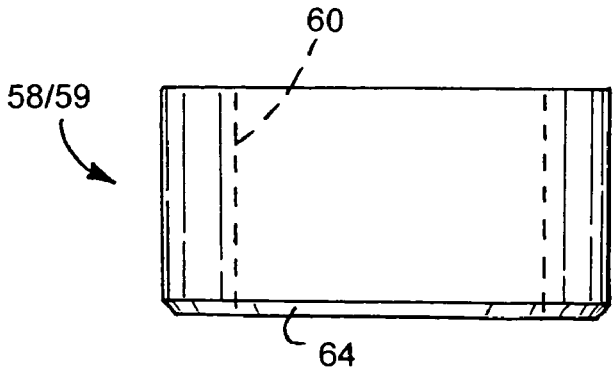
FIG. 7 is an enlarged elevational view of one form of brake pin bushing.

In a preferred embodiment, each brake pin bushing 58, 59 is suitably configured to facilitate insertion into their respective bores 51, 53 defined by strut 37. Although only one brake pin bushing is illustrated in FIG. 7, it will be appreciated the other brake pin bushing is preferably similarly configured. As shown by way of example in FIG. 7, each brake pin bushing is preferably provided with an annular chamfer or angled edge 64 extending about the outside diameter thereof and adjacent the end of the brake pin bushing 58, 59 adapted to be initially inserted into the respective bore of strut 37.

Figure 8:
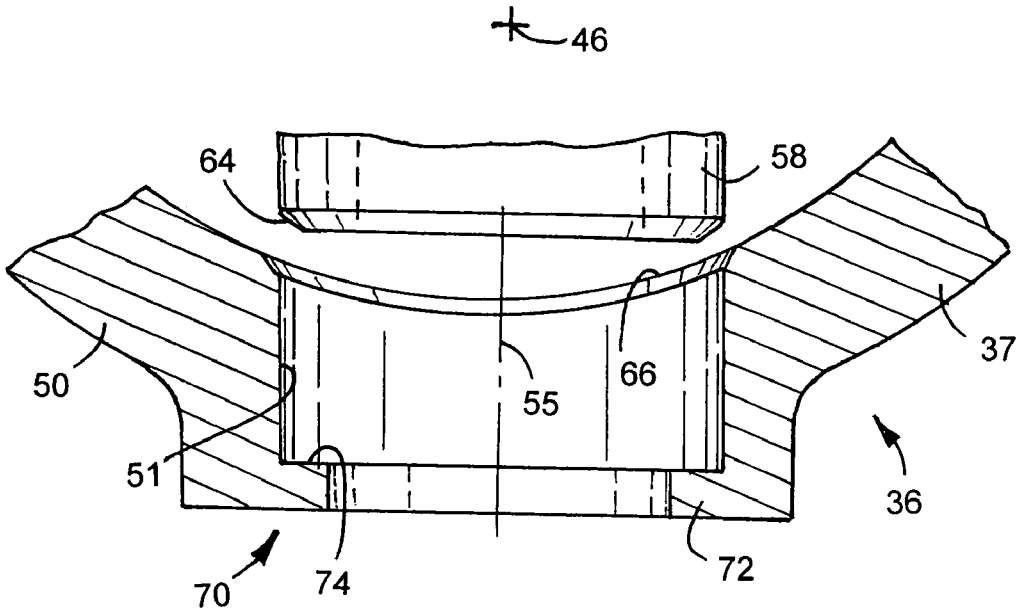
FIG. 8 is enlarged sectional view of an alternative form for the brake beam strut.

Although only one strut bore is shown by way of example in FIG. 8, it should be appreciated the other strut bore is preferably similarly configured. As schematically illustrated in FIG. 8, the annular marginal edge of each strut bore disposed closet to the longitudinal centerline or axis 46 of strut 37 can be chamferred or otherwise configured to facilitate insertion of the brake pin bushing 58, 59 into operable combination with the strut 37.

In yet another embodiment, both the end of each brake pin bushing and the each strut bore can be configured to facilitate insertion of the brake pin bushing into the respective strut bore. That is, the end of each brake pin bushing adapted to be initially inserted into the respective strut bore can be chamferred or otherwise configured to facilitate insertion of the brake pin bushing 58, 59 into operable combination with the strut 37. Additionally, the annular marginal edge of each strut bore disposed closet to the longitudinal centerline or axis 46 of strut 37 can be chamferred or otherwise configured to facilitate insertion of the brake pin bushing 58, 59 into operable combination with the strut 37.

In a preferred embodiment, and as mentioned above, each brake pin bushing 58, 59 is pressed into operable association with strut 37 until each brake pin bushing reaches a predetermined position within the respective bore 51, 53 of strut 37. Preferably, a stop, generally indicated in FIG. 8 by reference numeral 70, is provided in operable combination with each bushing brake pin bushing 58, 59 of the strut assembly 36. Stop 70 preferably serves two purposes. First, stop 70 serves to limit the extent to which each brake pin bushing 58, 59 is pressed into their respective bores 51, 53 in the strut 37 (FIG. 4). Second, stop 70 serves to inhibit inadvertent axial shifting movements of the brake pin bushings 58, 59 in a direction away from the axis 46 of the strut assembly 36 during operation of the brake beam assembly 30.

Since the stop 70 operably associated with brake pin bushing 58 is preferably the same as the stop 70 operably associated with the brake pin bushing 59, only the stop 70 arranged in operable combination with brake pin bushing 58 will be discussed in detail. In the embodiment illustrated in FIG. 8, stop 70 includes a lip 72 provided on the strut 37 and which is preferably arranged at the radial outermost edge of the strut bore 51 to effectively and operably reduce the diameter of the strut bore 51. As shown by way of example in FIG. 8, lip 72 extends radially inward from the diameter of the strut bore 51 toward the axis 55 defined by the aligned bores 51, 53 (FIG. 4) for a distance less than one half the diameter of that portion of the brake lever pin 54 (FIG. 4) passing through brake pin bushing 58. Lip 72 combines with the larger diameter of the strut bore 51 to define a radial shoulder 74 against which an end of the brake pin bushing 58 abuts after the brake pin bushing 58 is pressed into its predetermined position relative to the respective bore 51, 53 of strut 37. As will be appreciated from an understanding of the present disclosure, the lip 72 of stop also serves to inhibit shifting movements of the brake pin bushing 58 in a direction away from axis 46 of strut assembly during operation of the brake beam assembly 30 (FIG. 4.).

In the example in FIG. 4, lip 72 has an annular configuration. Of course, lip 72 can be otherwise configured without detracting or departing from the spirit and scope of this disclosure. That is, lip 72 can be defined by two or more projections extending radially inward toward the axis 55 to an extent permitting the lengthwise portion of the brake lever pivot pin 54 to operably pass unhindered through the bushings 58, 59. The two or more projections forming the lip 72 can be radially spaced from each other but combine with each other to limit axial insertion of the brake pin bushings 58, 59 in their respective bores defined by strut 37.

Figure 9:
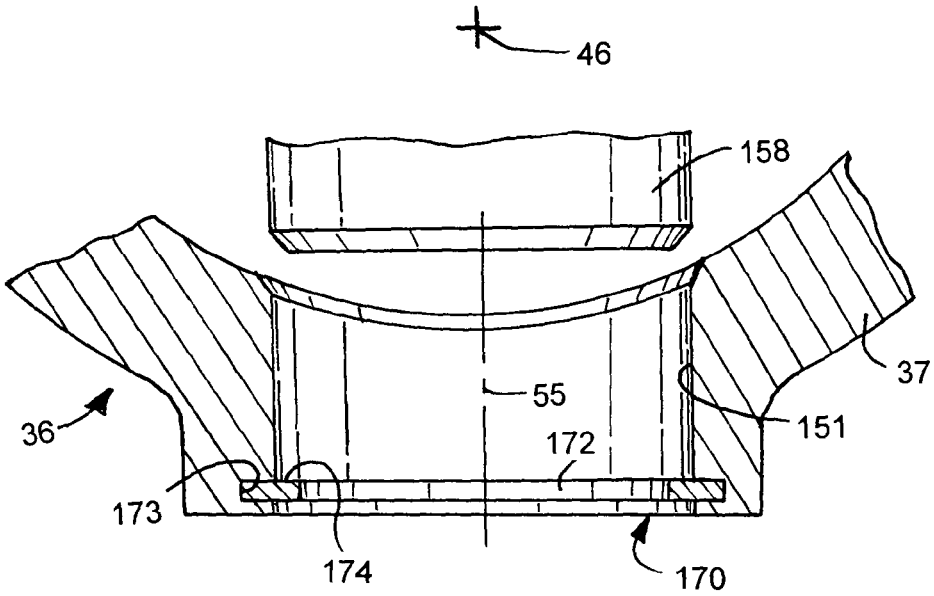
FIG. 9 is a sectional view similar to FIG. 8 showing an alternative design for limiting insertion of the brake pin bushing into operable association with a brake beam strut.

FIG. 9 is an illustration of another form of stop adapted to be arranged in operable combination with each brake pin bushing of the strut assembly 36. Although only one stop is illustrated in FIG. 9, from the above it should be appreciated a similar stop is provided in combination with the strut bore on the opposite side of the strut. This alternative form of limit stop is designated generally by reference numeral 170. The elements of the railroad freight car strut assembly arranged in operable combination with the this alternative form of limit stop that are functionally analogous to those component discussed above regarding strut 36 are designated by reference numerals identical to those listed above with the exception this embodiment uses reference numerals in the 100 series.

In the embodiment illustrated in FIG. 9, stop 170 includes a resilient ring 172, such as a conventional snap-ring, seated within a suitably configured recess 173 on the strut 37. The recess 173 and, thus, ring 172, is preferably arranged toward the radial outermost edge of the strut bore 151 to effectively and operably reduce the diameter of the strut bore 151. As shown by way of example in FIG. 9, ring 172 extends radially inward from the diameter of the strut bore 151 toward the brake pin pivot axis 55 for a distance less than one half the diameter of that portion of the brake lever pivot pin passing through brake pin bushing 158. The annular ring 172 combines with the larger diameter of the strut bore 151 to define a radial shoulder 174 against which an end of the brake pin bushing 158 abuts after the brake pin bushing 158 is pressed into its predetermined position relative to the respective bore 151 of the strut.

Figure 10:
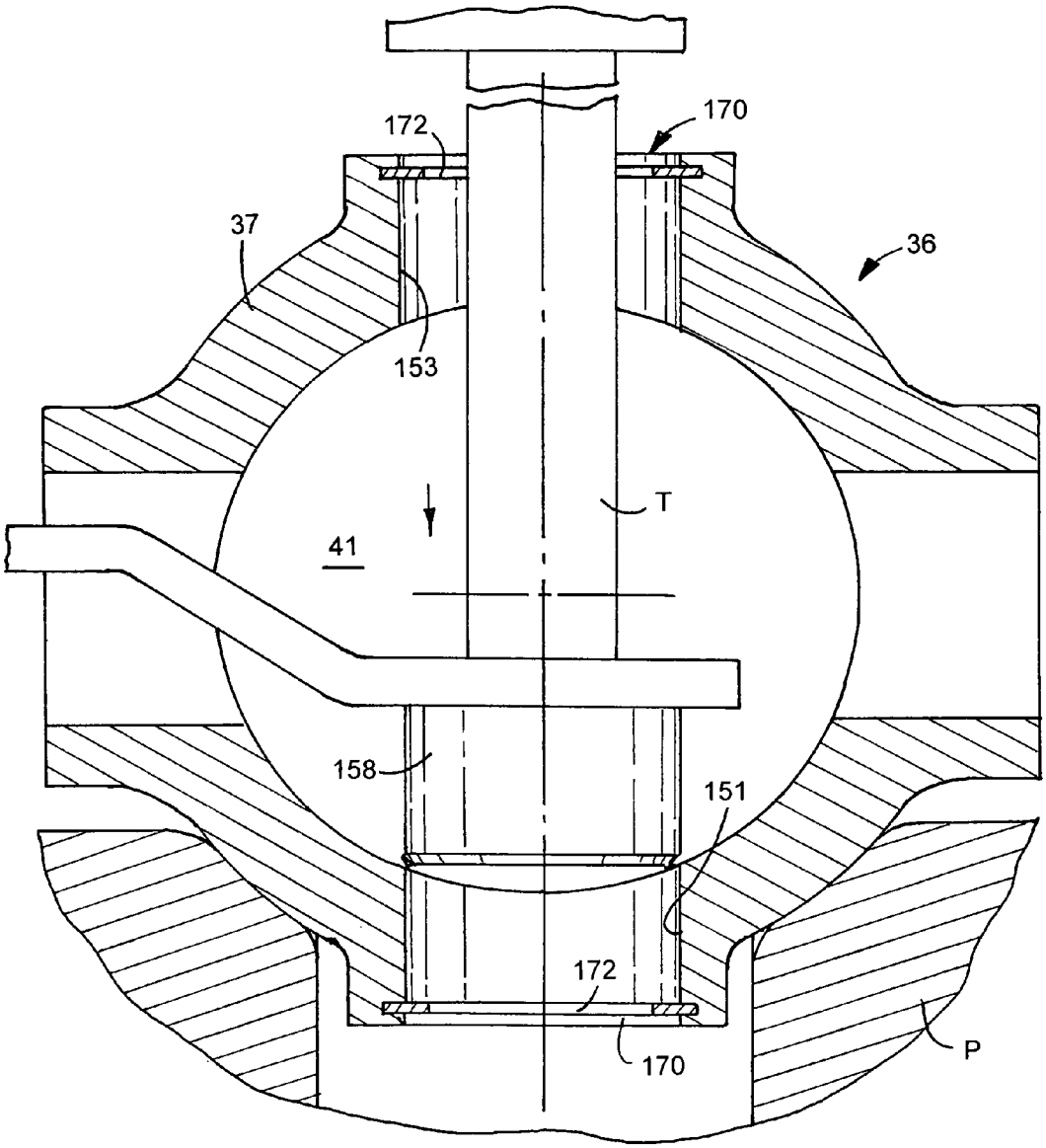
FIG. 10 is an enlarged sectional view similar to that shown in FIG. 5 showing a brake pin bushing being pressed into position relative to a brake beam strut designed with a stop as illustrated in FIG. 9.
Figure 11:
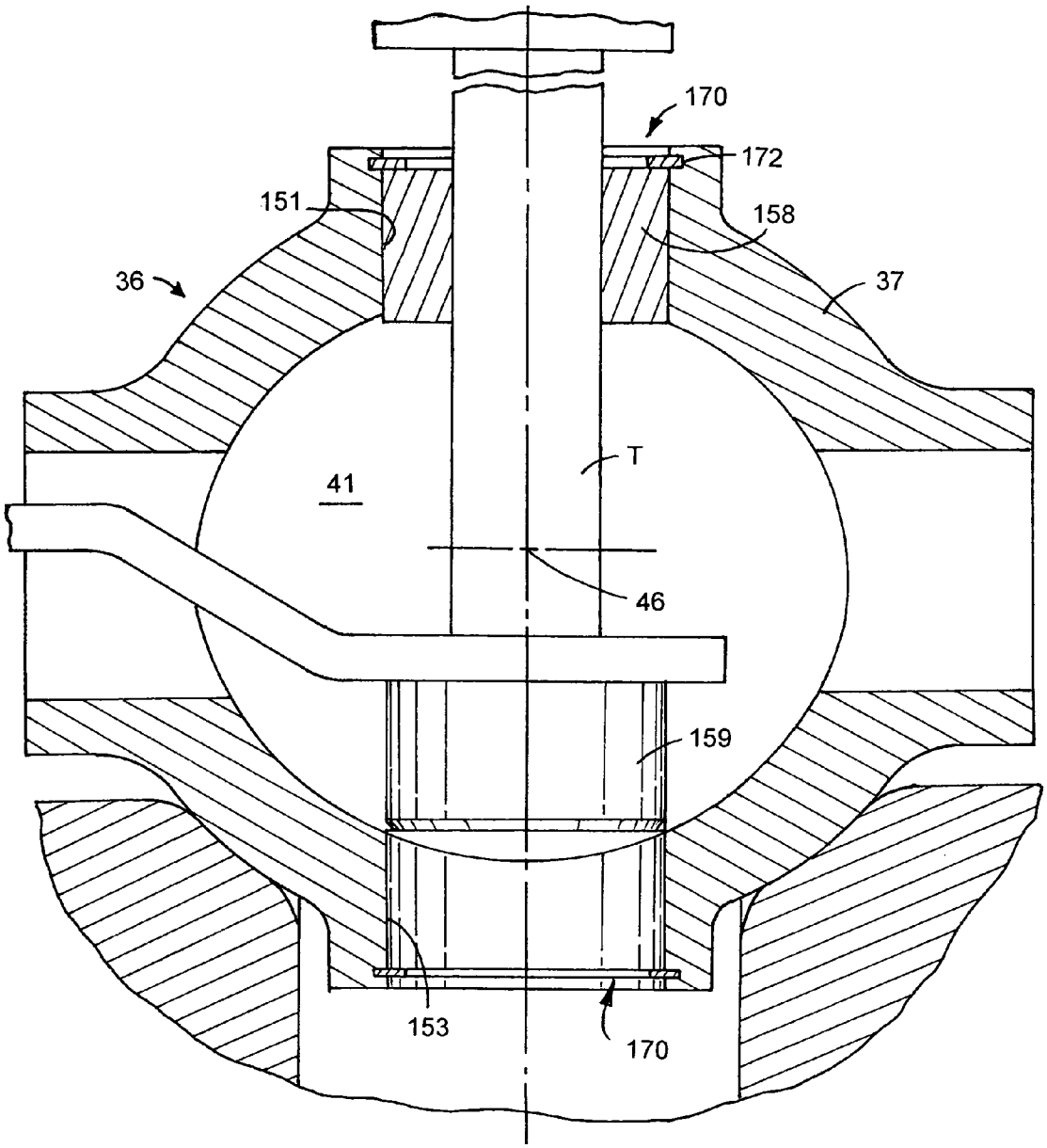
FIG. 11 is an enlarged sectional view similar to that shown in FIG. 11 showing another brake pin bushing being pressed into position relative to a brake beam strut designed with a stop as illustrated in FIG. 9.

FIGS. 10 and 11 schematically illustrate brake pin bushing 158 (FIG. 10) and brake pin bushing 159 (FIG. 11) being pressed into their respective bores in a strut having a stop 170 associated with each bore 151, 153 and in directions opposed from each other and extending away from the longitudinal axis 46 of the strut.

Figure 12:
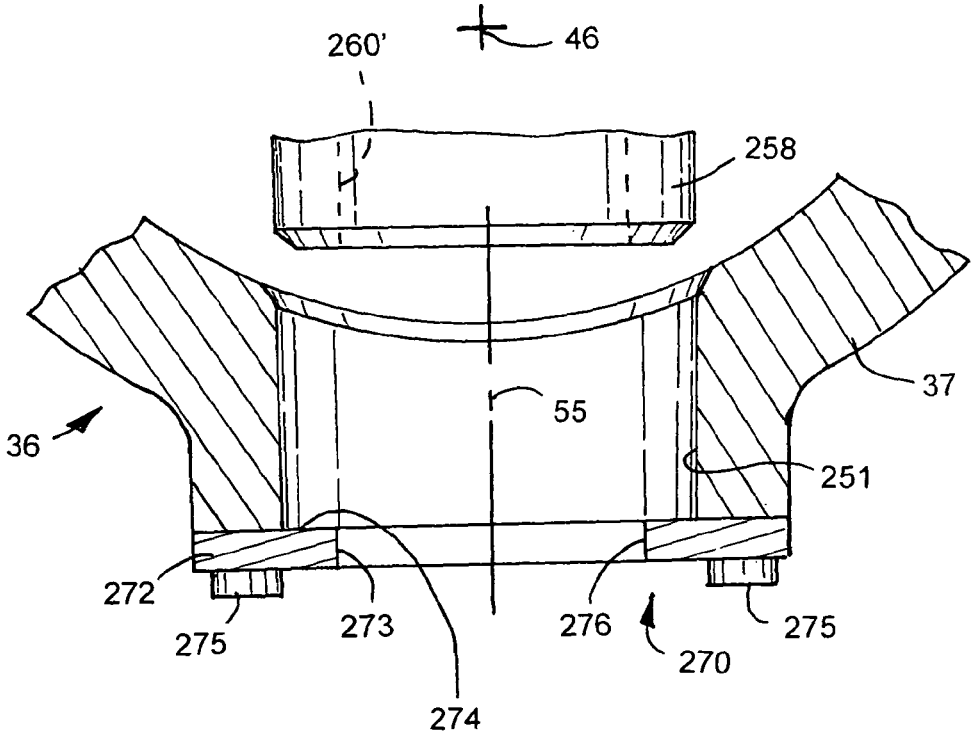
FIG. 12 is a sectional view similar to FIG. 8 showing an alternative design for limiting insertion of the brake pin bushing into operable association with a brake beam strut.

FIG. 12 is an illustration of another form of stop suitable for arrangement in operable combination with each brake pin bushing of the strut assembly 36. Although only one stop is illustrated in FIG. 12, from the above it should be appreciated a similar stop is provided in combination with the strut bore on the opposite side of the strut. This alternative form of limit stop is designated generally by reference numeral 270. The elements of the railroad freight car strut assembly arranged in operable combination with the this alternative form of limit stop that are functionally analogous to those component discussed above regarding strut 36 are designated by reference numerals identical to those listed above with the exception this embodiment uses reference numerals in the 200 series.

In the embodiment illustrated in FIG. 12, stop 270 includes a plate or member 272 having an aperture 273. As shown, the plate 272 is suitably secured to an exterior of the strut 37 such that the opening or aperture 273 coaxially aligns with the respective strut bore 251 about brake pin pivot axis 55. Plate 272 can be secured to the exterior of the strut 37 using any suitable means such as adhesive and/or suitable mechanical fasteners 275. As shown by way of example in FIG. 12, the aperture or opening 273 in plate 272 preferably has a closed margin defining an inner diameter 276 which is smaller or less than the inner diameter 260' defined by the bore 260 of the brake pin bushing with which stop 270 is operably associated but larger than that portion of the brake lever pivot pin passing through the respective brake pin bushing. As shown, plate 272 combines with the diameter of the strut bore 251 to define a radial shoulder 274 against which an end of the brake pin bushing 258 abuts after the brake pin bushing 258 is pressed into its predetermined position relative to the respective bore of the strut 37. The shoulder 274 of stop 270 furthermore inhibits the respective brake pin bushing from moving therepast during operation of the brake beam assembly 30.

Figure 13:
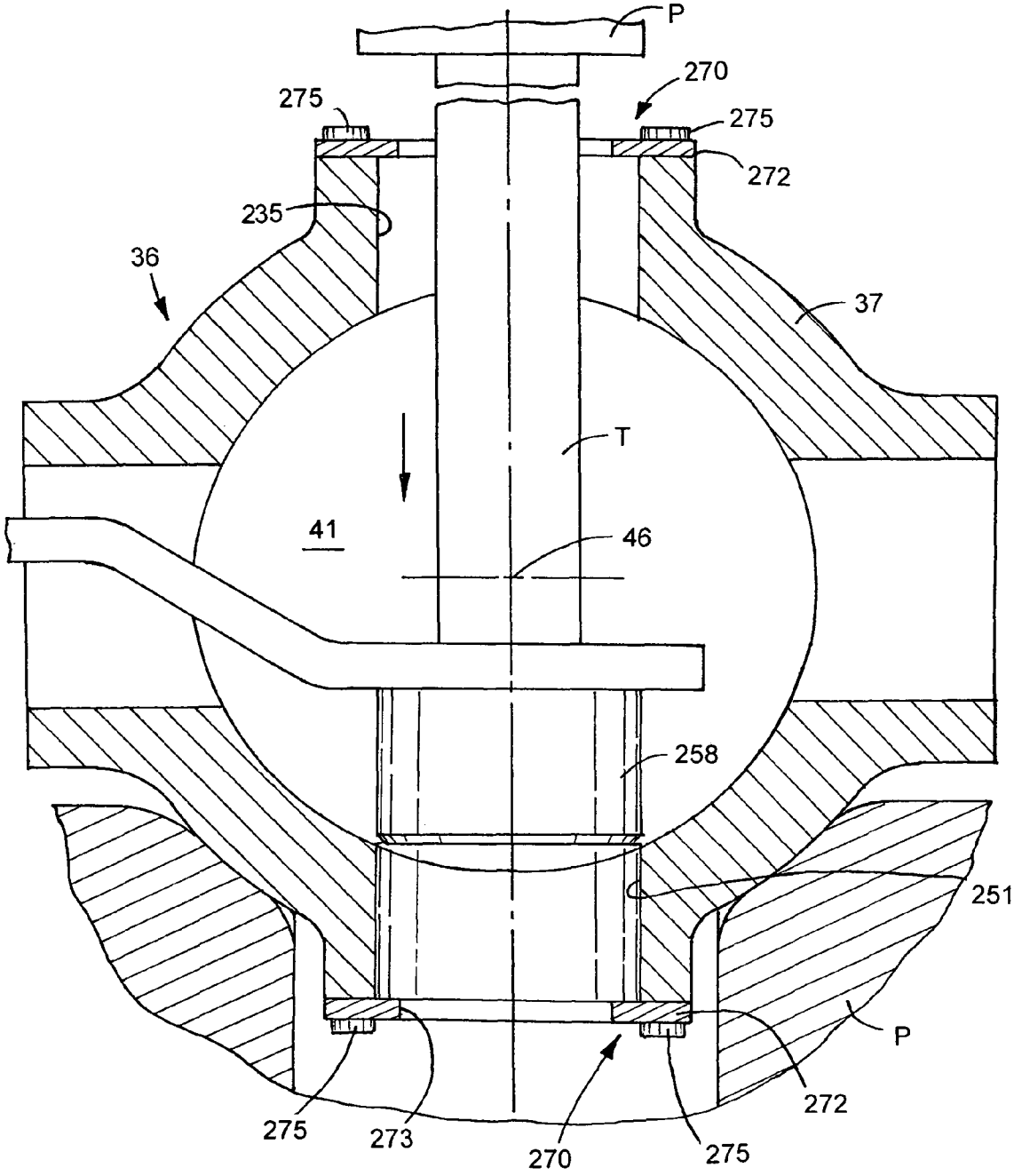
FIG. 13 is an enlarged sectional view similar to that shown in FIG. 5 showing a brake pin bushing being pressed into position relative to a brake beam strut designed with a stop as illustrated in FIG. 12.
Figure 14:
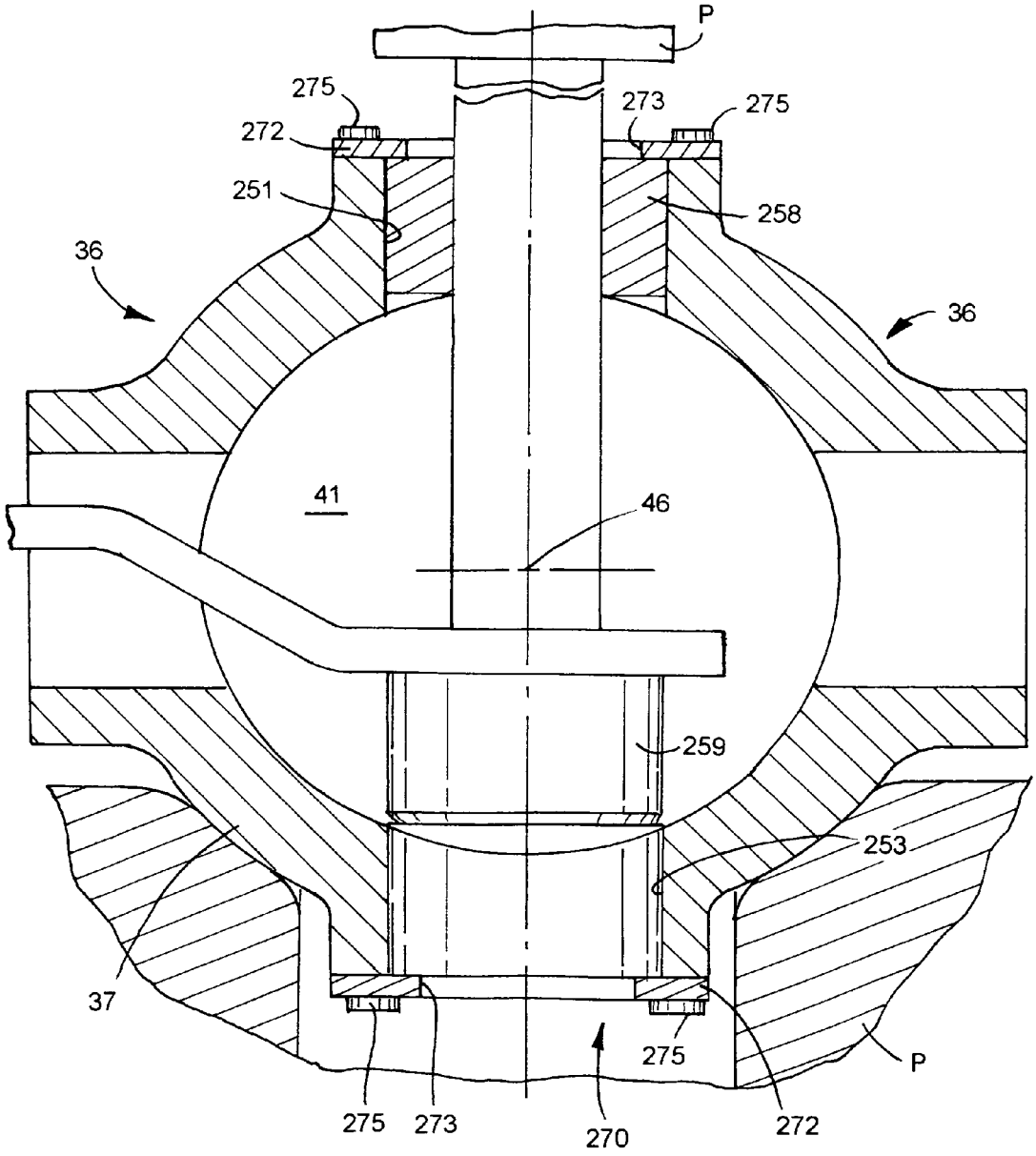
FIG. 14 is an enlarged sectional view similar to that shown in FIG. 13 showing another brake pin bushing being pressed into position relative to a brake beam strut designed with a stop as illustrated in FIG. 12.

FIGS. 13 and 14 schematically illustrate the brake pin bushing 258 (FIG. 13) and brake pin bushing 259 (FIG. 14) being pressed into their respective bores in a strut having a stop 270 associated with each bore 251, 253 and in directions opposed from each other and extending away from the longitudinal axis 46 of the strut.

Figure 15:
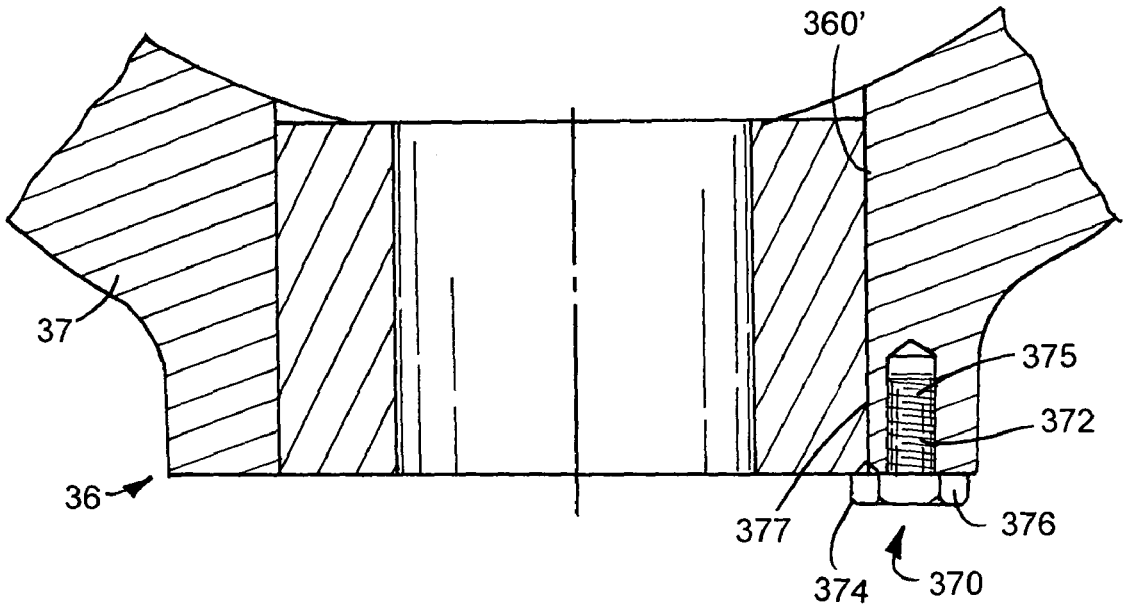
FIG. 15 is a sectional view similar to FIG. 8 showing an alternative design for limiting insertion of the brake pin bushing into operable association with a brake beam strut.

FIG. 15 is an illustration of yet another form of a stop adapted for arrangement in operable combination with each brake pin bushing of the strut assembly 36. Although only one stop is illustrated in FIG. 15, from the above it should be appreciated a similar stop is provided in combination with the strut bore on the opposite side of the strut. This alternative form of limit stop is designated generally in FIG. 15 by reference numeral 370. The elements of the railroad freight car strut assembly arranged in operable combination with the this alternative form of limit stop that are functionally analogous to those component discussed above regarding strut 36 are designated by reference numerals identical to those listed above with the exception this embodiment uses reference numerals in the 300 series.

Figure 16:
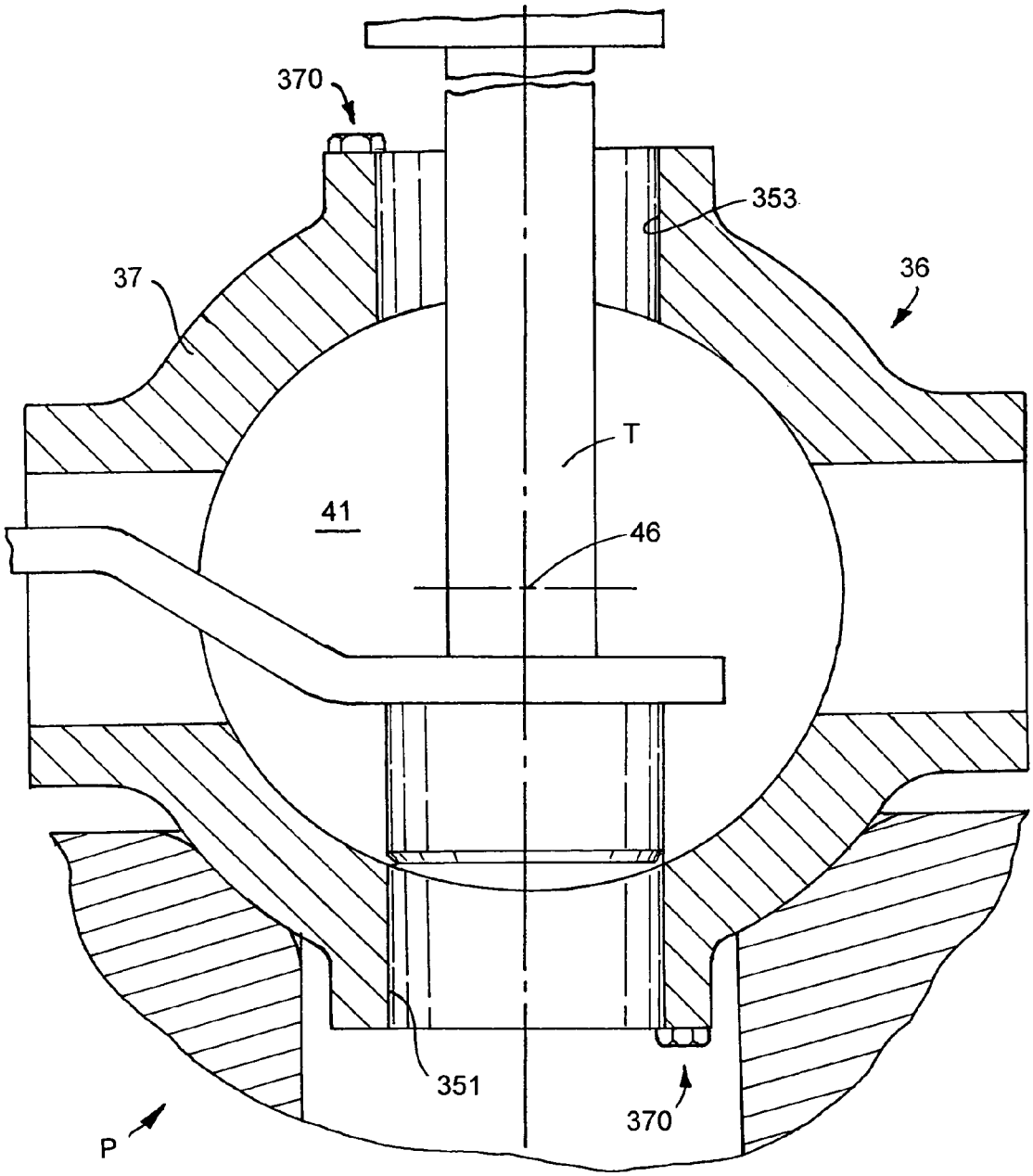
FIG. 16 is an enlarged sectional view similar to that shown in FIG. 5 showing a brake pin bushing being pressed into position relative to a brake beam strut designed with a stop as illustrated in FIG. 15.
Figure 17:
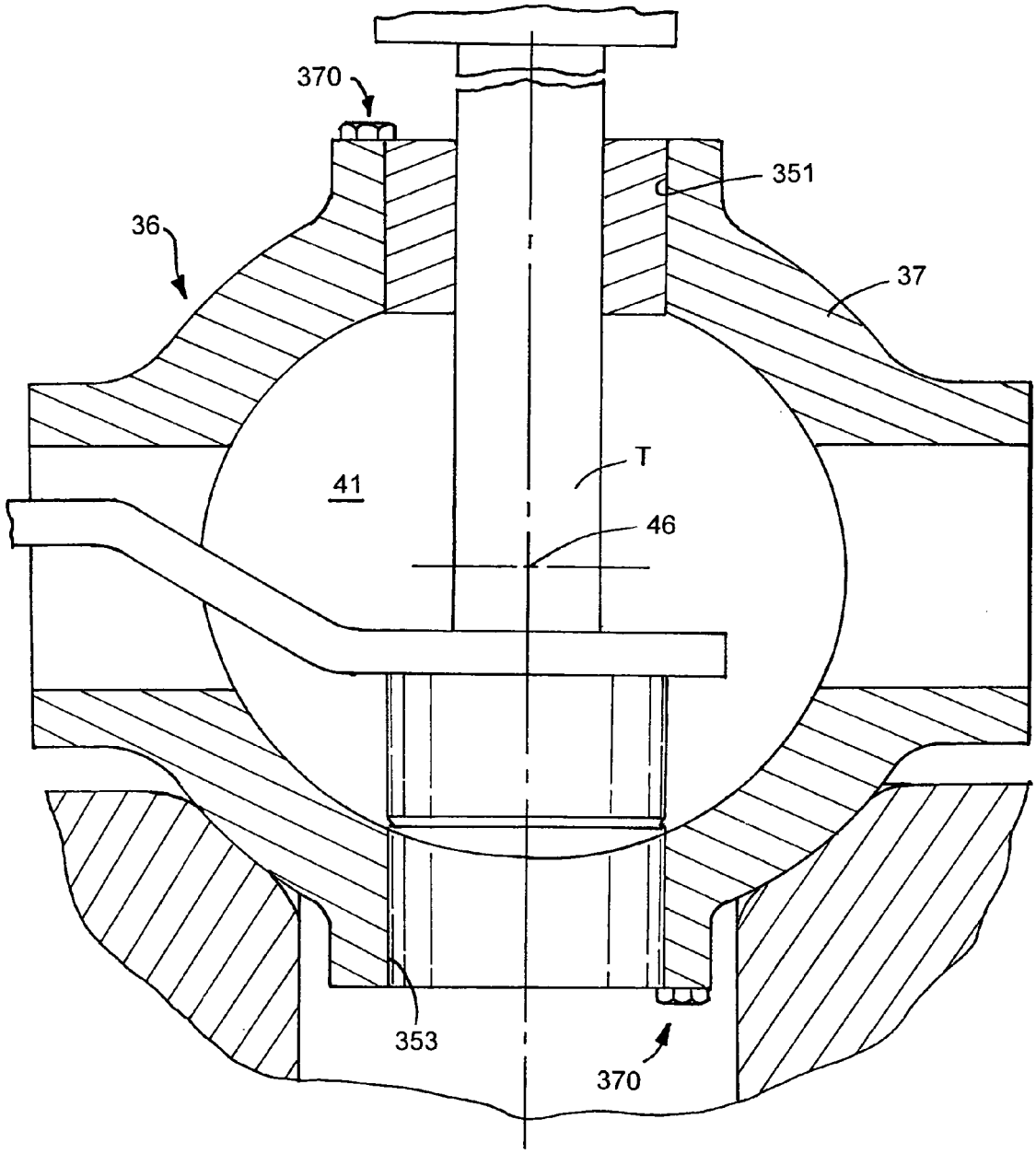
FIG. 17 is an enlarged sectional view similar to that shown in FIG. 16 showing another brake pin bushing being pressed into position relative to a brake beam strut designed with a stop as illustrated in FIG. 15.

In the embodiment illustrated in FIG. 15, stop 370 includes a threaded fastener 372 secured to the exterior of strut 37 in radial relation to each strut bore 351 and 353 (FIGS. 16 and 17). As shown by way of a single example in FIG. 15, fastener 372 has a threaded shank portion 375 and an enlarged head portion 376. The threaded shank portion 375 of fastener 372 is threadably accommodated within a threaded bore 377 defined by strut 37 in predetermined radial relation relative to the inner diameter 360' of the brake pin bushing receiving bore in the strut 37. Suffice it to say, when fastener 372 is threaded into the bore 377, at least a portion of the enlarged head portion 376 is configured to extend radially past the diameter of the brake pin bushing receiving bore in strut 37 whereby defining a shoulder 374 for limiting insertion of the brake pin bushing into its predetermined position relative to the respective bore of the strut and for inhibiting inadvertent axial displacement of the respective brake pin bushing during operation of the brake beam assembly 30 (FIG. 2). Notably, the enlarged head portion 376 of fastener 372 is configured to extend radially past the diameter of the brake pin bushing receiving bore in strut 37 only to that extent required to inhibit axial displacement of the respective brake pin bushing therepast while allowing for that portion of the brake lever pivot pin passing through the respective brake pin bushing bore to move therepast without obstruction. It is also within the spirit and scope of the present disclosure to arrange a washer or other form of annular member in operable combination with such a fastener and wherein only a radial portion of such washer would extend radially past the diameter of the brake pin bushing receiving bore in strut 37 only to that extent required to prevent axial displacement of the respective brake pin bushing therepast while allowing for that portion of the brake lever pivot pin passing through the respective brake pin bushing bore to move therepast without obstruction.

FIGS. 16 and 17 schematically illustrate the brake pin bushing 358 (FIG. 16) and brake pin bushing 359 (FIG. 17) being pressed by a tool T into a strut having stop 370 associated with each bore 351, 353 and in directions extending away from the longitudinal axis 46 of the strut 37.

Figure 18:
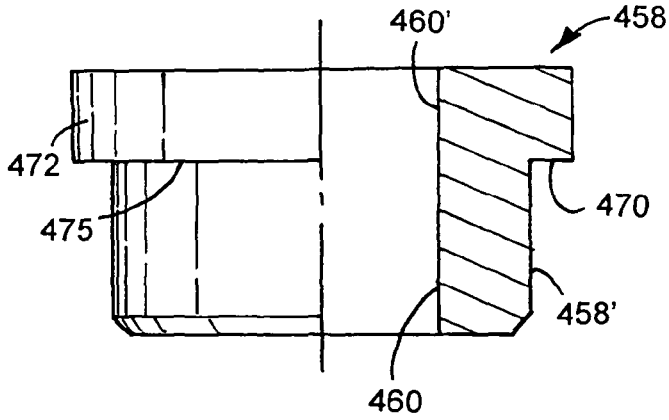
FIG. 18 is an enlarged view of an alternative form of brake pin bushing, partially in section, embodying features of the present disclosure.

Another form of brake pin bushing, generally identified by reference numeral 458 in FIG. 18, includes a stop for: 1) limiting the extent to which each brake pin bushing is pressed into their respective bores in the strut; and, 2) inhibiting axial movement of the respective brake pin bushing in a direction away from the axis 46 of strut assembly 36 (FIG. 19) during operation of the brake beam assembly 30 (FIG. 2). In this embodiment, however, the stop operably associated with each brake pin bushing is formed as part of the brake pin bushing. Although only one brake pin bushing having a stop is illustrated in FIG. 18, from the above it should be appreciated a similar brake pin bushing is provided in combination with the strut bore on the opposite side of the strut. This alternative form of limit stop arranged in operable combination with the brake pin bushing is designated in FIG. 18 generally by reference numeral 470. The elements of the railroad freight car strut assembly arranged in operable combination with the this alternative form of limit stop that are functionally analogous to those component discussed above regarding strut 37 are designated by reference numerals identical to those listed above with the exception this embodiment uses reference numerals in the 400 series.

As shown in FIG. 18, brake pin bushing 458 is provided with an radially enlarged head portion 472 and an axially elongated shank portion 474. The head portion 472 and shank portion 474 of bushing 458 are arranged in axially aligned relation relative to each other. In the illustrated embodiment, the head portion 472 and shank portion 474 of bushing 458 have a combined axial length generally equal to the cross sectional thickness (the distance between the inner and outer surfaces in the area wherein the strut bore passes) of the strut 37. The shank portion 474 of the brake pin bushing has an outer diameter 458' sized to establish a snug fit within the strut bore 451 in the side wall 50 of strut 37. In one form, the each brake pin bushing is such that a press fit is established between the outer diameter 458' of the shank portion 474 of the brake pin bushing 458 and the inner diameter of the respective strut bore into which the brake pin bushing is to be inserted. Brake pin bushing 458 also defines a throughbore 460 having an inner diameter 460' sized relative to that portion of the brake lever pivot pin passing theretrough.

The head portion 472 of each brake pin bushing is sized radially larger than the outside diameter 458' of the shank portion 474 of the brake pin bushing 458 such that a radial shoulder 475 is defined therebetween. Shoulder 475 on the brake pin bushing is designed to abut against the inner surface of the strut after the brake pin bushing is pressed into its predetermined position relative to the respective bore of the strut. Notably, the head portion 472 of the brake pin bushing is configured to extend radially past the outer diameter 458' of the shank portion 474 of the brake pin bushing only to the extent required to limit axial displacement of the respective brake pin bushing into the respective strut bore into which the brake pin bushing is inserted and to limit inadvertent axial displacement of the brake pin bushing in a direction away from the axis 46 of strut assembly 36 during operation of the brake beam assembly 30 (FIG. 2).

Figure 19:
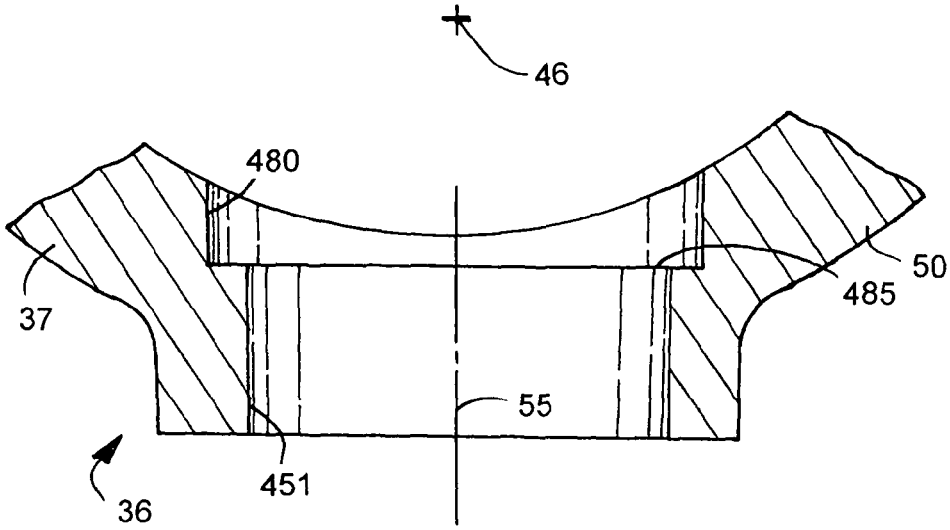
FIG. 19 is enlarged sectional view of an alternative form for the brake beam strut designed to operate in combination with a brake pin bushing of the type shown in FIG. 18.

In the exemplary embodiment illustrated in FIG. 19, the end of the brake pin bushing receiving strut bore disposed closet to the axis 46 of the strut 37 is configured to enhance the spacial relationship between the brake pin bushings and the brake lever adapted to fit therebetween. More specifically, and in the embodiment illustrated in FIG. 19, that end of the strut bore disposed closet to the axis 46 of the strut 37 is configured with a counterbore 480 arranged in coaxial alignment with the strut bore. As shown, the counterbore 480 defines a radial shoulder 485. The counterbore 480 is sized to accommodate the head portion 472 of the brake pin bushing. Moreover, the radial shoulder 485 of counterbore 480 is adapted to cooperate with the radial shoulder 475 on the brake pin bushing whereby affecting axial positioning of the respective brake pin bushing into the respective strut bore into which the brake pin bushing is pressed while enhancing the spacial relationship of the brake pin bushings on opposite sides of the brake lever 42.

Figure 20:
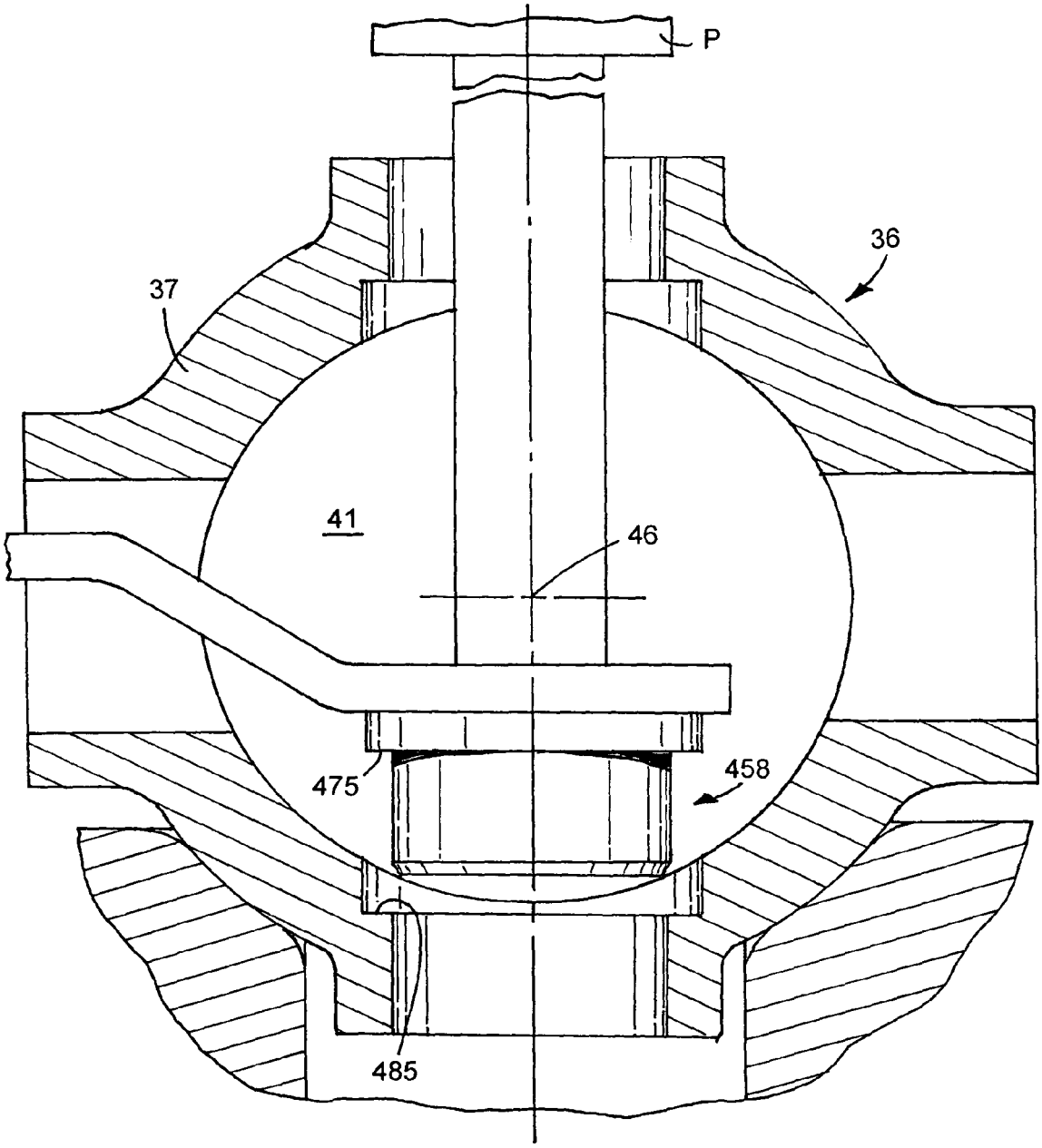
FIG. 20 is an enlarged sectional view similar to that shown in FIG. 5 showing a brake pin bushing of the type shown in FIG. 18 being pressed into position relative to a brake beam strut of the type illustrated in FIG. 19.
Figure 21:
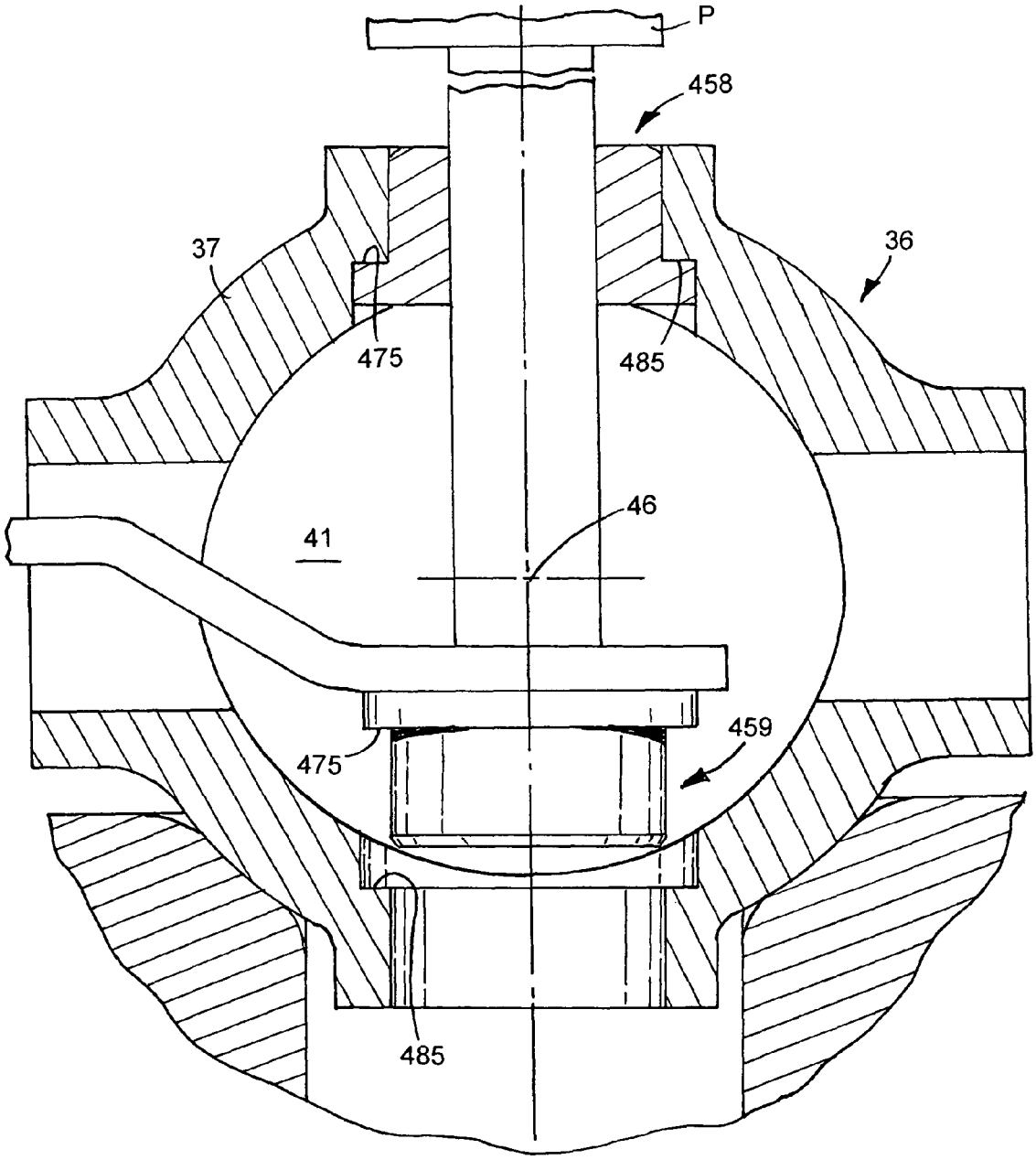
FIG. 21 is an enlarged sectional view similar to that shown in FIG. 20 showing another brake pin bushing of the type shown in FIG. 18 being pressed into position relative to a brake beam strut of the type illustrated in FIG. 19.
Figure 23:
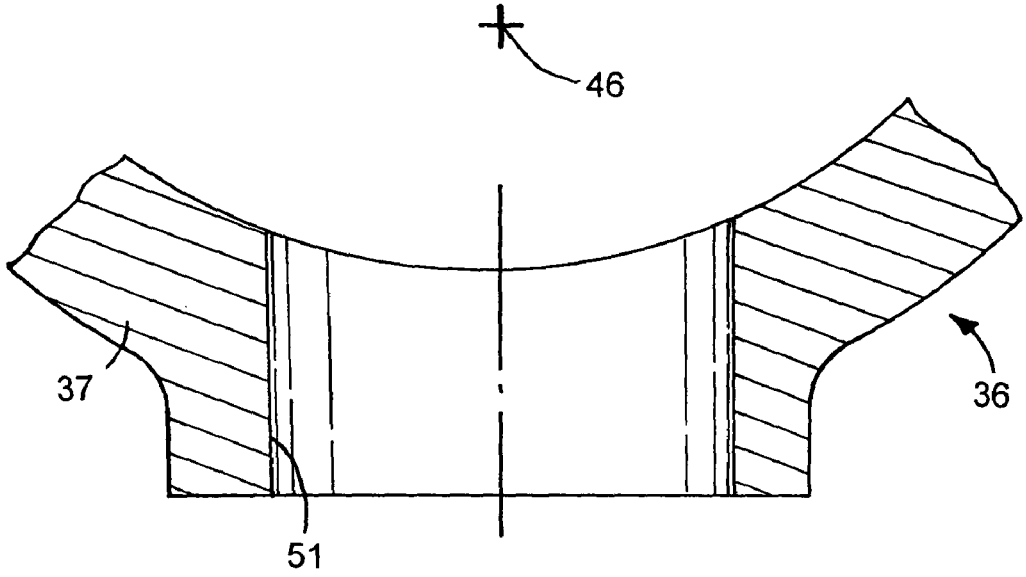
FIG. 23 is enlarged view of a brake beam strut having a brake pin bushing of the type shown in FIG. 18 inserted into operable combination therewith.

FIGS. 20 and 21 schematically illustrate the brake pin bushing 458 (FIG. 20) and brake pin bushing 459 (FIG. 21) being pressed into their respective bores in the strut 37. In this embodiment, each brake pin bushing 458, 459 is pressed into its respective strut bore in a direction extending away from the longitudinal axis 46 of the strut preferably until the shoulder 475 on the brake pin bushing engages with the shoulder 485 defined by the strut 37.

Figure 22:
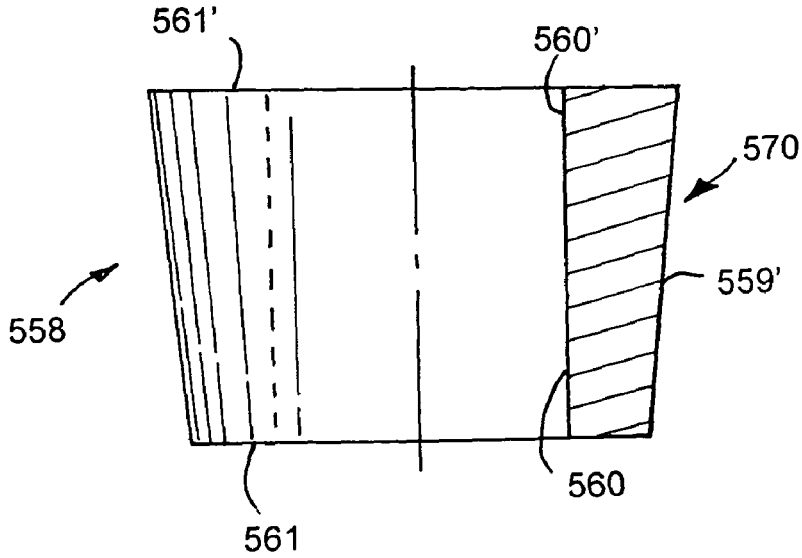
FIG. 22 is an enlarged view of an alternative form of brake pin bushing, partially in section, embodying features of the present disclosure.

Still another form of brake pin bushing, generally identified by reference numeral 558 in FIG. 22, includes a stop for both limiting the extent to which each brake pin bushing is pressed into their respective bores in the strut and inhibiting axial movement of the respective brake pin bushing in a direction away from the axis 46 of strut assembly 36 (FIG. 19) during operation of the brake beam assembly 30 (FIG. 2). As in the exemplary embodiment illustrated in FIG. 18, in this embodiment of brake pin bushing, the stop for accomplishing the desired ends is formed as part of each brake pin bushing. Although only one brake pin bushing having a stop is illustrated in FIG. 22, from the above it should be appreciated a similar brake pin bushing is provided in combination with the strut bore on the opposite side of the strut. This alternative form of limit stop on the brake pin bushing is designated in FIG. 22 generally by reference numeral 570. The elements of the railroad freight car strut assembly arranged in operable combination with the this alternative form of limit stop that are functionally analogous to those component discussed above regarding strut 37 are designated by reference numerals identical to those listed above with the exception this embodiment uses reference numerals in the 500 series.

According to this embodiment, and as shown in FIG. 22, each brake pin bushing has a first end 561 adapted to be initially inserted into one of the brake pin bushing receiving bores on the strut and a second end 561' arranged in axially spaced relation from the first end. The ends 561 and 561' of each brake pin bushing are preferably separated by an axial distance generally equal to the cross sectional thickness (the distance between the inner and outer surfaces in the area wherein the strut bore passes) of the strut 37. Each brake pin bushing furthermore defines a bore 560 opening to the first and second ends, 561 and 561', respectively, of each bushing. The bore 560 of each brake pin bushing has an inner diameter 560' which is sized relative to that portion of the brake lever pivot pin 54 passing therethrough.

In this embodiment, each brake pin bushing further has a tapering outside surface 559' whereby providing the brake pin bushing with a slight frusto-conical outer configuration. That is, the outer generally cylindrical surface of each brake pin bushing has a substantially constant taper extending axially between the first and second ends 561 and 561', respectively, of the bearing. In the illustrated embodiment, the end of the brake pin bushing disposed proximate to the first end 561 has an outer diameter which is only slightly less than the inner diameter of the strut bore into which it is to be inserted. In one form, the end of the brake pin bushing disposed proximate to the first end 561 has an outer diameter which is about 0.005 inches smaller than the diameter of the strut bore into which the brake pin bushing is to be inserted. In the illustrated embodiment, that end of the brake pin bushing disposed proximate to the second end 561' has an outer diameter which is slightly larger than the inner diameter of the strut bore into which it is to be inserted. In one form, the end of the brake pin bushing disposed proximate to the second end 561' has an outer diameter which is about 0.030 inches larger than the diameter of the strut bore into which the brake pin bushing is to be inserted. Of course, rather than taper the outer surface of each brake pin bushing, it is within the spirit and scope of the present disclosure to either: taper the inner surface of the respective strut bores and maintain a substantially constant diameter for each brake pin bushing; or, to taper both the inner surface of the respective strut bores and the outer surface of each brake pin bushing to accomplish the desired end of inhibiting inadvertent axial shifting of the brake pin bushings in away from the axis 46 of the strut 37 after such brake pin bushings are arranged in operable combination with the strut 37.

In the illustrated embodiment, the outer surface 559' of each brake pin bushing preferably has a generally constant taper between the opposed ends 561, 561'. As such, and when the brake pin bushing is pressed into the respective strut bore, in a direction extending generally normal to the axis 46 of the strut 37, a lengthwise portion of the tapering outer surface 559' of the brake pin bushing will operably engage with the inner surface of the strut bore into which the bushing is being pressed in a manner inhibiting axial movement of the brake pin bushing in a direction extending away from the axis 46 of strut 37.

Figure 24:
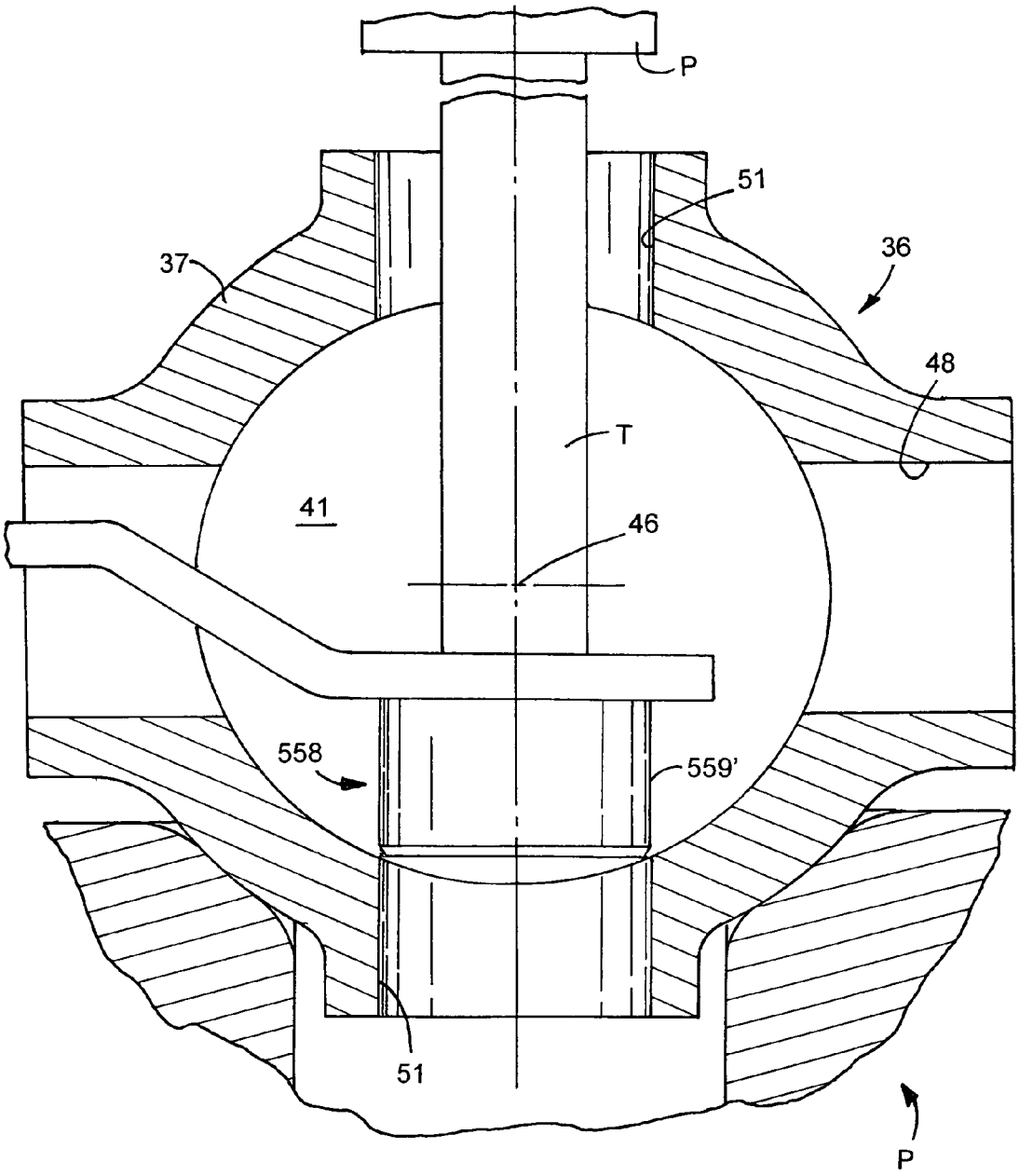
FIG. 24 is an enlarged sectional view similar to that shown in FIG. 5 showing a brake pin bushing of the type shown in FIG. 22 being pressed into position relative to a brake beam strut.
Figure 25:
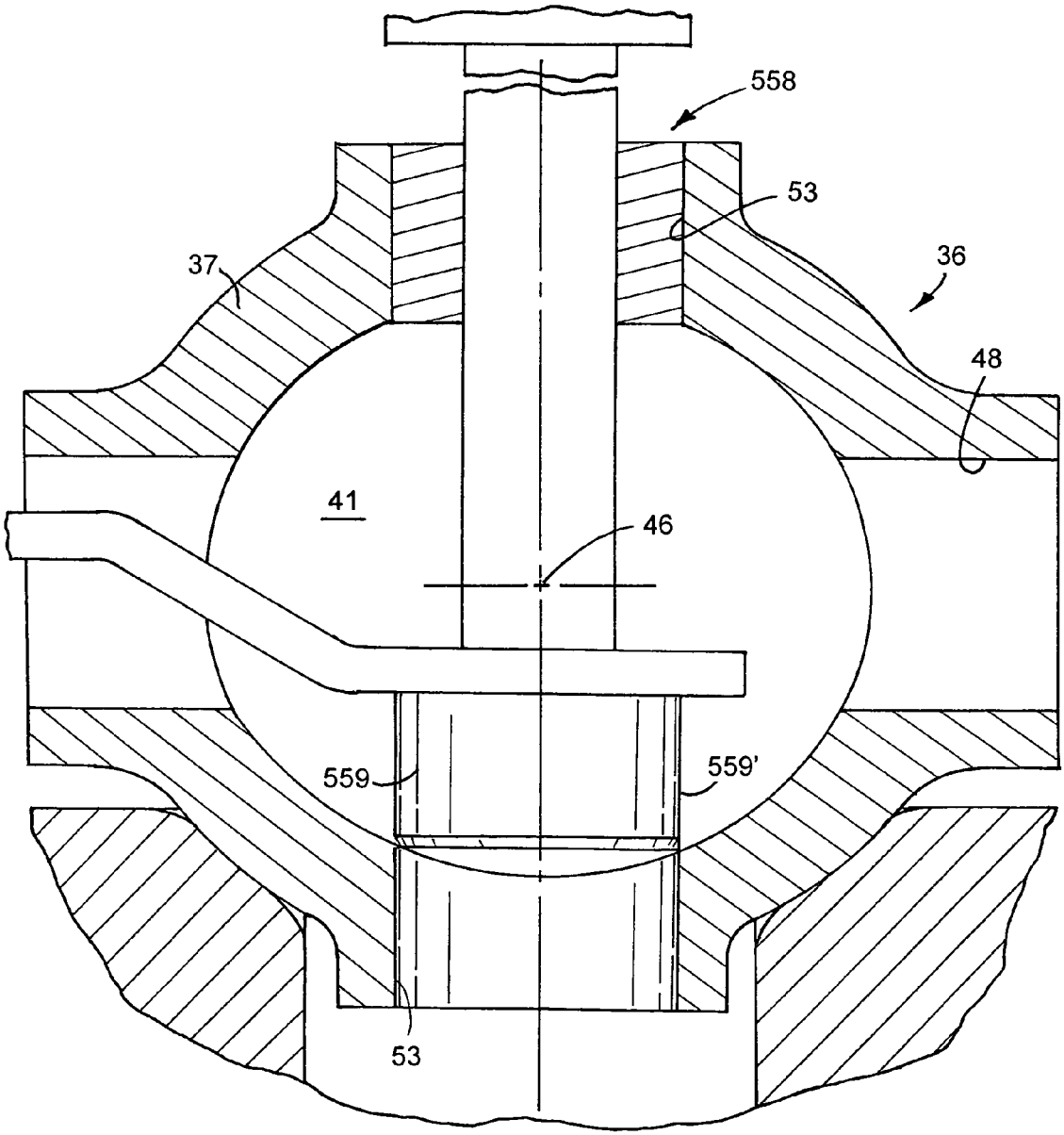
FIG. 25 is an enlarged sectional view similar to that shown in FIG. 24 showing another brake pin bushing of the type shown in FIG. 22 being pressed into position relative to a brake beam strut.

FIGS. 24 and 25 schematically illustrate the brake pin bushing 558 (FIG. 24) and brake pin bushing 559 (FIG. 25) being pressed into their respective bores in the strut 37. As mentioned, each brake pin bushing 558, 559 is pressed into its respective strut bore in a direction extending away from the longitudinal axis 46 of the strut until the tapering outer surface 559' on the brake pin bushing engages with the inner surface of the respective strut bore whereby operably stopping the bushing and operably positioning the bushing in a predetermined relation with the strut 37.

Regardless of which variety of stop or brake pin bushing design is utilized in combination with the strut assembly, and although the brake pin bushings are inclined a predetermined number of degrees from vertical during use of the brake beam assembly 30, one of the salient features of this disclosure involves the process of pressing the brake pin bushings into their respective strut bores in a direction away from the axis 47 of the strut 37. Moreover, the use of a limit stop in operable combination with each bushing, whether formed as part of the strut or part of the brake pin bushing, serves to positively position each brake pin bushing in predetermined relation relative to the respective strut bore into which the bushing is pressed. Furthermore, the provision of a limit stop in operable combination with each brake pin bushing and/or strut advantageously serves to limit inadvertent axial displacement of either brake pin bushing in the respective strut bore in a direction extending away from the longitudinal axis of the strut thus prolonging the usefulness of the brake pin bushings while maintaining a fixed axis about which brake lever rotates thereby enhancing performance of the brake beam assembly over an extended time period. The ability to maintain the brake pin bushings in operable combination with the strut while limiting axial displacement of the brake pin bushings away from the centerline of the strut during brake operation provides the brake lever, pivoting about the brake pin journalled by the bushings, with a relatively constant axis about which to pivot thereby offering consistent performance of the brake beam assembly during operation. These and other objects, aims and advantages of the present disclosure are all provided with minimal costs and simplistic design changes.

From the foregoing, it will be observed that numerous modifications and variations can be made and effected without departing or detracting from the true spirit and novel concept of the present disclosure. Moreover, it will be appreciated, the present disclosure is intended to set forth an exemplifications which are not intended to limit the disclosure to the specific embodiment illustrated. Rather, this disclosure is intended to cover by the appended claims all such modifications and variations as fall within the spirit and scope of the claims.

What is claimed is:

1. A method of manufacturing a railroad freight car brake beam strut assembly, comprising the steps of:

providing a railroad freight car brake beam strut having an axially elongated slot defined between first and second sides of said strut, with each side of said strut defining a bore opening to a center of said strut and to an exterior of said strut, with the bores defined by said strut being aligned relative to each other along an axis extending generally normal to a longitudinal axis of said strut; and pressing a brake pin bushing into each bore of said strut in a direction extending away from the longitudinal axis of said strut; and providing a positive stop defined by said strut toward an end of each bushing disposed a furthest distance from a longitudinal centerline of said strut for inhibiting each brake pin bushing from moving therepast after each bushing is inserted into each bore defined by said strut.

2. The method of manufacturing a railroad freight car brake beam strut assembly according to claim 1 comprising the further step of:

configuring at least one end of each brake pin bushing to facilitate and guide its entry into one of said bores defined by said strut.

3. A method of manufacturing a railroad freight car brake beam strut assembly, comprising the steps of:

providing a railroad freight car brake beam strut having an axially elongated slot defined between first and second sides of said strut, with said first side of said strut defining a first bore opening to a center of said strut and to an exterior of said strut, and with the second side of said strut defining a second bore opening to a center of said strut and to the exterior of said strut, with said first and second bores defined by said strut being aligned relative to each other along an axis extending generally normal to a longitudinal axis of said strut;

pressing a first brake pin bushing into the first bore of said strut in a direction extending away from the longitudinal axis of said strut; and pressing a second brake pin bushing into the second bore of said strut in a direction opposed to the direction said first bushing is pressed into said first bore and extending away from the longitudinal axis of said strut; and providing a positive stop on said strut toward an end of each bushing disposed a furthest distance from a longitudinal centerline of said strut for inhibiting each brake pin bushing from moving therepast after each bushing is inserted into each bore defined by said strut.

4. The method of manufacturing a railroad freight car brake beam strut assembly according to claim 3 wherein said first and second brake pin bushings each define an opening extending therethrough.

5. The method of manufacturing a railroad freight car brake beam strut assembly according to claim 4 comprising the further step of:

repositioning said strut after said first brake pin bushing is pressed into said first bore and before said second brake pin bushing is pressed into said second bore in said strut.

6. The method of manufacturing a railroad freight car brake beam strut assembly according to claim 4 comprising the further step of:

inserting a tool operably coupled to a press through the opening in said first brake pin bushing and into engagement with the second brake pin bushing so as to press the second brake pin bushing into the second bore of said strut in a direction opposed to the direction said first brake pin bushing is pressed into said first bore and extending away from the longitudinal axis of said strut.

7. The method of manufacturing a railroad freight car brake beam strut assembly according to claim 3 comprising the further step of:

configuring at least one end of each brake pin bushing to facilitate and guide their entry into one of said bores defined by said strut.

8. The method of manufacturing a railroad freight car brake beam strut assembly according to claim 3 wherein said stop for each brake pin bushing is formed integral with said strut.

9. A method of manufacturing a railroad freight car brake beam strut assembly, comprising the steps of:

providing a railroad freight car brake beam strut having a longitudinal centerline and an axially elongated slot defined between first and second sides of said strut, with said first side of said strut defining a first bore opening to a center of said strut and to an exterior of said strut, and with said second side of said strut defining a second bore opening to a center of said strut and to the exterior of said strut, with said first and second bores defined by said strut being aligned relative to each other along an axis extending generally normal to a longitudinal axis of said strut;

pressing a first sintered powdered metal brake pin bushing into the first bore of said strut in a direction extending away from the longitudinal axis of said strut;

pressing a second sintered powdered metal brake pin bushing into the second bore of said strut in a direction opposed to and paralleling the direction said first brake pin bushing is pressed into said first bore and extending away from the longitudinal axis of said strut;

providing a first stop on said strut toward that end of the first bore disposed furthest from the longitudinal centerline of said strut for inhibiting said first brake pin bushing from inadvertently separating from said strut after being pressed into the first bore defined by said strut; and providing a second stop on said strut toward that end of the second bore disposed furthest from the longitudinal centerline of said strut for inhibiting said second brake pin bushing from inadvertently separating from said strut after said second bushing is pressed into the second bore defined by said strut.

10. The method of manufacturing a railroad freight car brake beam strut assembly according to claim 9 comprising the further step of:

configuring at least one end of each sintered powdered metal brake pin bushing to facilitate and guide its entry into one of said bores defined by said strut.

11. The method of manufacturing a railroad freight car brake beam strut assembly according to claim 9 comprising the further step of:

repositioning said strut after said first brake pin bushing is positioned in said first bore and before said second brake pin bushing is pressed into said second bore in said strut.

12. The method of manufacturing a railroad freight car brake beam strut assembly according to claim 9 wherein the stop for each brake pin bushing is formed integral with said strut.

13. A railroad freight car brake beam strut assembly, comprising:

an elongated strut defining a longitudinal axis and having an axially elongated slot between first and second joined walls of said strut, with the slot in said strut being inclined a predetermined number of degrees from vertical for accommodating an elongated brake lever extending through said strut, with each side wall of said strut defining a bore opening to a center of said strut and to an exterior of said strut, with the bores defined by the walls on said strut being aligned relative to each other to accommodate a brake lever pivot pin extending through strut thereby connecting the brake lever to said strut and so as to define an axis about which said brake lever pivots;

a pair of brake pin bushings, with one brake pin bushing being accommodated in each bore defined by the strut so as to journal said brake lever pivot pin; and a positive stop defined by said strut toward an end of each bushing disposed a furthest distance from a the longitudinal centerline of said strut, with at least a portion of each stop extending radially inward from an inner diameter of a respective bore for inhibiting the respective brake pin bushing from moving therepast after each bushing is inserted into each bore defined by said strut.

14. The railroad freight car brake beam strut assembly according to claim 13, wherein each brake pin bushing is sized relative to the bore in said strut such that an interference fit is established between a periphery of said brake pin bushing and an inside diameter of the bore defined by said strut.

15. The railroad freight car brake beam strut assembly according to claim 13, wherein each brake pin bushing is formed from powdered sintered metal material.

16. A railroad freight car brake beam strut assembly, comprising:

an elongated strut defining a longitudinal axis and having an axially elongated slot between first and second joined walls of said strut, with the slot in said strut being inclined a predetermined number of degrees from vertical for accommodating an elongated brake lever extending through said strut, with each side wall of said strut defining a bore opening to a center of said strut and to an exterior of said strut, with the bores defined by the walls on said strut being aligned relative to each other to accommodate a brake lever pivot pin extending through strut thereby connecting the brake lever to said strut and so as to define an axis about which said brake lever pivots;

a pair of brake pin bushings, with at least one brake pin bushing being accommodated in each bore defined by the strut so as to journal said brake lever pivot pin; and a stop provided on said strut toward an end of each bushing disposed a furthest distance from a the longitudinal centerline of said strut for inhibiting each brake pin bushing inserted into each bore defined by said strut from moving therepast whereby maintaining each bushing in a predetermined relation relative to said strut.

17. The railroad freight car brake beam strut assembly according to claim 16, wherein each brake pin bushing is sized relative to the bore in said strut such that an interference fit is established between a periphery of said brake pin bushing and an inside diameter of the bore defined by said strut.

18. The railroad freight car brake beam strut assembly according to claim 16, wherein each brake pin bushing is formed from powdered sintered metal material.

19. The railroad freight car brake beam strut assembly according to claim 16, wherein each of said stops is formed integral with said strut.

20. The railroad freight car brake beam strut assembly according to claim 16, wherein each of said stops extends radially inward from an inner diameter of the bore into which each bushing is inserted.

21. A railroad freight car brake beam strut assembly, comprising:

an elongated strut defining a longitudinal axis and having an axially elongated slot between first and second joined walls of said strut, with the slot in said strut being inclined a predetermined number of degrees from vertical for accommodating an elongated brake lever extending through said strut, with each side wall of said strut defining a bore opening to a center of said strut and to an exterior of said strut, with the bores defined by the walls on said strut being aligned relative to each other to accommodate a brake lever pivot pin extending through strut thereby connecting the brake lever to said strut and so as to define an axis about which said brake lever pivots;

a pair of brake pin bushings, with at least one brake pin bushing being accommodated in each bore defined by the strut so as to journal said brake lever pivot pin, with each brake pin bushing including a first end, disposed farthest from the longitudinal axis of said strut after said bushing is inserted into said bore and into operable association with said strut, and a second end, disposed closer to the longitudinal axis of said strut than is said first end after said bushing is inserted into said bore and into operable association with said strut; and a stop on said strut and operably associated with the first end of each bushing for limiting the extent to which each brake pin bushing can move in a direction away from the longitudinal axis of said strut.

22. The railroad freight car brake beam strut assembly according to claim 21, wherein each brake pin bushing is sized relative to the bore in said strut such that an interference fit is established between a periphery of said brake pin bushing and an inside diameter of the bore defined by said strut.

23. The railroad freight car brake beam strut assembly according to claim 21, wherein each brake pin bushing is formed from powdered sintered metal material.

24. The railroad freight car brake beam strut assembly according to claim 21 , wherein each stop is formed integral with said strut.

25. The railroad freight car brake beam strut assembly according to claim 21, wherein each stop extends radially inward from an inner diameter of the bore into which each bushing is inserted.

* * * * *